US009788609B2

(12) United States Patent
James et al.

(10) Patent No.: US 9,788,609 B2
(45) **Date of Patent: *Oct. 17, 2017**

(54) ARTICLE OF FOOTWEAR WITH ADJUSTABLE FITTING SYSTEM

(71) Applicant: NIKE, Inc., Beaverton, OR (US)

(72) Inventors: Dervin A. James, Hillsboro, OR (US); Zachary M. Elder, Portland, OR (US); Elizabeth A. Kilgore, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 19 days.

This patent is subject to a terminal disclaimer.

(21) Appl. No.: 14/945,734

(22) Filed: Nov. 19, 2015

(65) Prior Publication Data

US 2016/0073739 A1 Mar. 17, 2016

Related U.S. Application Data

(63) Continuation of application No. 14/039,225, filed on Sep. 27, 2013, now Pat. No. 9,220,318.

(51) Int. Cl.
*A43C 11/00* (2006.01)
*A43B 13/18* (2006.01)
(Continued)

(52) U.S. Cl.
CPC ..... *A43C 11/006* (2013.01); *A43B 3/26* (2013.01); *A43B 5/04* (2013.01); *A43B 11/00* (2013.01);
(Continued)

(58) Field of Classification Search
CPC ..... A43B 13/00; A43B 3/26; A43B 5/0421; A43C 11/002; A43C 11/004;
(Continued)

(56) References Cited

U.S. PATENT DOCUMENTS 1,130,859 A * 3/1915 Thomas ..... A43B 1/02 12/142 G
1,155,506 A * 10/1915 Osaki ..... A43B 7/20 36/136
(Continued)

FOREIGN PATENT DOCUMENTS

CN 202335387 U 7/2012
DE 1084173 B 6/1960
(Continued)

OTHER PUBLICATIONS

1 Hour Cycling Shoe, Industrial Designer Benjamin R. Lloyd, http://www.benjaminlloyd.com/industrialdesign/1-hour-cycling-shoe, 3pp., accessed Mar. 25, 2013.
(Continued)

*Primary Examiner* — Shaun R Hurley
*Assistant Examiner* — Bao-Thieu L Nguyen
(74) *Attorney, Agent, or Firm* — Honigman Miller Schwartz and Cohn LLP; Matthew H. Szalach; Jonathan P. O'Brien

(57) ABSTRACT

An article of footwear includes a fitting system with an upper member that is supported by the upper and a strand guide that is supported by the sole structure. The strand guide is flexible and flexes in concert with the sole structure. The strand guide has a guide surface. The fitting system further includes a tensioning system with a flexible strand that is configured to bias the upper member toward the strand guide. The flexible strand has a first section coupled to the upper member and a second section extending through the sole structure. The second section abuts the guide surface. The second section is configured to slide across the guide surface as a result of flexure of the strand guide. The first section and the upper member are configured to move
(Continued)

relative to the sole structure as a result of sliding of the second section across the guide surface.

20 Claims, 15 Drawing Sheets

(51) Int. Cl.
*A43B 11/00* (2006.01)
*A43B 5/04* (2006.01)
*A43C 11/16* (2006.01)
*A43B 3/26* (2006.01)

(52) U.S. Cl.
CPC ..... *A43B 13/18* (2013.01); *A43C 11/002* (2013.01); *A43C 11/004* (2013.01); *A43C 11/008* (2013.01); *A43C 11/16* (2013.01); *A43C 11/165* (2013.01)

(58) Field of Classification Search
CPC ..... A43C 11/006; A43C 11/008; A43C 11/12; A43C 11/16; A43C 11/165; A43C 11/18
USPC ..... 36/50.1, 50.5, 25 R, 23, 54, 3 A, 97, 36/117.7, 118.1
See application file for complete search history.

(56) References Cited

U.S. PATENT DOCUMENTS 1,197,783 A * 9/1916 Winbray ..... A43C 1/00 36/50.1
1,556,167 A * 10/1925 Smiley ..... A43C 11/08 36/50.1
1,652,354 A * 12/1927 Grubs ..... A43C 11/02 36/50.1
2,072,785 A 3/1937 Herman
2,084,671 A 6/1937 Curran
2,088,851 A 8/1937 Gantenbein
2,143,556 A 1/1939 Hodaly
2,147,197 A 2/1939 Gidden
2,314,098 A 3/1943 McDonald
2,343,390 A 3/1944 Ushakoff
2,395,767 A * 2/1946 Sutcliffe ..... A43B 3/122 36/11.5
2,440,393 A 4/1948 Clark
2,495,984 A 1/1950 Roy
2,526,940 A * 10/1950 Fello ..... A43B 3/122 36/11.5
2,569,764 A 10/1951 Jonas
2,608,078 A 8/1952 Anderson
2,641,004 A 6/1953 Whiting et al.
2,680,309 A * 6/1954 Peterson ..... A43B 3/122 36/101
2,862,311 A * 12/1958 Ellis ..... A43B 1/14 36/11.5
2,984,917 A * 5/1961 Saunders ..... A43B 5/18 280/811
3,408,754 A * 11/1968 Kueter ..... A43B 5/0415 36/117.1
3,583,081 A 6/1971 Hayashi
3,703,775 A 11/1972 Gatti
3,769,722 A * 11/1973 Rhee ..... A43B 5/00 36/2 R
3,793,749 A 2/1974 Gertsch et al.
3,983,642 A * 10/1976 Liao ..... A43B 3/24 36/101
4,083,124 A * 4/1978 Michalak ..... A43B 3/16 36/7.1 R
4,178,925 A * 12/1979 Hirt ..... A61F 5/0195 36/97
4,190,970 A * 3/1980 Annovi ..... A43B 5/0449 24/70 SK
4,297,798 A * 11/1981 Colan ..... A43B 3/24 36/101
4,338,735 A * 7/1982 Spademan ..... A43B 5/0447 36/118.1
4,447,967 A 5/1984 Zaino et al.
4,467,538 A * 8/1984 Olivieri ..... A43B 5/0449 36/117.1
4,513,520 A * 4/1985 Koch ..... A43B 5/0405 36/10
4,530,171 A * 7/1985 Zabala ..... A43B 3/126 36/11.5
4,592,154 A 6/1986 Oatman
4,654,985 A * 4/1987 Chalmers ..... A43B 3/0084 24/68 SK
4,750,339 A 6/1988 Simpson, Jr. et al.
4,756,098 A 7/1988 Boggia
4,766,682 A * 8/1988 Malloy, III ..... A43B 3/0078 36/132
4,785,558 A 11/1988 Shiomura
4,794,706 A * 1/1989 Puckhaber ..... A43B 3/26 36/170
4,811,503 A * 3/1989 Iwama ..... A43B 5/0449 36/118.1
4,813,158 A 3/1989 Brown
4,815,222 A * 3/1989 Eisenbach ..... A43B 5/14 36/131
4,942,678 A * 7/1990 Gumbert ..... A43B 1/14 24/713.4
4,972,609 A * 11/1990 Oh ..... A43B 5/00 36/114
5,003,711 A 4/1991 Nerrinck et al.
5,269,078 A * 12/1993 Cochrane ..... A43B 5/00 36/170
5,291,671 A * 3/1994 Caberlotto ..... A43B 5/00 36/114
5,345,638 A 9/1994 Nishida
5,371,957 A 12/1994 Gaudio
5,381,609 A * 1/1995 Hieblinger ..... A43C 11/165 36/50.1
5,423,134 A * 6/1995 Bagnaia ..... A43B 3/128 36/101
5,463,822 A 11/1995 Miller
5,566,476 A * 10/1996 Bertrand ..... A43B 5/18 36/72 R
5,678,329 A 10/1997 Griffin et al.
5,692,319 A * 12/1997 Parker ..... A43B 7/1495 36/114
5,711,092 A * 1/1998 Despres ..... A43C 13/14 36/133
5,732,483 A * 3/1998 Cagliari ..... A43B 5/0401 36/115
5,755,044 A 5/1998 Veylupek
5,791,021 A 8/1998 James
5,794,360 A * 8/1998 Bell ..... A43C 11/1493 24/306
5,966,842 A * 10/1999 Hart, Jr. ..... A43C 11/14 36/50.1
6,032,387 A * 3/2000 Johnson ..... A43C 1/06 36/118.1
6,052,921 A * 4/2000 Oreck ..... A43C 1/00 36/50.1
6,286,233 B1 9/2001 Gaither
6,333,105 B1 12/2001 Tanaka et al.
D456,121 S 4/2002 Smith, III
6,378,230 B1 4/2002 Rotem et al.
6,467,194 B1 10/2002 Johnson
D472,041 S 3/2003 Kuerbis
6,598,322 B2 7/2003 Jacques et al.
6,637,130 B2 * 10/2003 Urie ..... A43B 3/126 36/11.5
6,763,614 B2 * 7/2004 Smith ..... A43C 11/00 36/50.1
6,772,541 B1 8/2004 Ritter et al.
6,832,442 B2 * 12/2004 Lewis ..... A43B 1/0081 36/7.1 R
6,883,254 B2 * 4/2005 Miller ..... A43B 1/0072 36/102
6,944,976 B2 * 9/2005 Sapp ..... A43B 5/18 36/100

(56) References Cited

U.S. PATENT DOCUMENTS 7,065,906 B2 6/2006 Jones et al.
7,134,224 B2 11/2006 Elkington et al.
7,200,957 B2 * 4/2007 Hubbard ..... A43B 5/00 36/50.1
7,272,897 B2 * 9/2007 Yu ..... A43B 1/0036 36/100
D553,842 S 10/2007 Paz
7,343,701 B2 3/2008 Pare et al.
7,392,990 B2 7/2008 Bussiere
7,562,470 B2 * 7/2009 Keen ..... A43B 3/22 36/50.1
7,568,298 B2 8/2009 Kerns
7,631,440 B2 * 12/2009 Keen ..... A43B 1/14 36/50.1
7,685,740 B2 3/2010 Sokolowski
7,703,218 B2 * 4/2010 Burgess ..... A43B 5/0419 36/50.1
7,793,435 B1 * 9/2010 Ruth ..... A43B 5/00 36/50.1
7,818,899 B2 10/2010 Dinndorf et al.
7,975,403 B2 7/2011 Mosher
7,987,617 B2 * 8/2011 Kohatsu ..... A43B 3/14 36/1
8,001,704 B2 8/2011 Baudouin
8,006,410 B2 8/2011 Romboli et al.
8,037,621 B2 * 10/2011 Hooper ..... A43B 7/06 36/102
8,074,379 B2 * 12/2011 Robinson, Jr. ..... A43C 1/06 36/108
D651,380 S 1/2012 Wilcots
8,151,490 B2 4/2012 Sokolowski
8,230,618 B2 7/2012 Bruce et al.
8,291,613 B2 * 10/2012 Cunningham ..... A43B 5/02 36/11.5
8,307,570 B2 * 11/2012 Delgatty ..... A43B 1/0027 36/100
8,387,282 B2 * 3/2013 Baker ..... A43C 11/008 36/133
8,424,225 B2 * 4/2013 Hazenberg ..... A43B 13/122 36/102
8,656,606 B2 * 2/2014 Hooper ..... A43B 7/06 36/102
8,707,587 B2 4/2014 Christensen et al.
8,850,721 B2 * 10/2014 Long ..... A43B 5/12 36/107
9,144,263 B2 * 9/2015 Elder ..... A43C 1/04
9,220,318 B2 * 12/2015 James ..... A43B 11/00
9,462,851 B2 * 10/2016 Baker ..... A43C 11/008
9,491,983 B2 * 11/2016 Rushbrook ..... A43B 13/141
2002/0148258 A1 10/2002 Cole et al.
2004/0181975 A1 9/2004 Piva et al.
2004/0226190 A1 11/2004 Elkington et al.
2005/0120593 A1 6/2005 Mason et al.
2005/0284000 A1 12/2005 Kerns
2006/0000116 A1 1/2006 Brewer
2006/0048413 A1 3/2006 Sokolowski et al.
2006/0117607 A1 6/2006 Pare et al.
2006/0242861 A1 * 11/2006 Dushey ..... A43B 3/103 36/101
2007/0011910 A1 1/2007 Keen
2007/0266598 A1 11/2007 Pawlus et al.
2008/0110049 A1 5/2008 Sokolowski et al.
2008/0216355 A1 * 9/2008 Becker ..... A43B 13/026 36/102
2009/0071041 A1 * 3/2009 Hooper ..... A43B 7/06 36/3 A
2009/0126231 A1 5/2009 Malmivaara
2010/0077634 A1 4/2010 Bell
2010/0146818 A1 * 6/2010 Sokolowski ..... A43B 5/12 36/102
2010/0154256 A1 6/2010 Dua
2010/0319216 A1 * 12/2010 Grenzke ..... A43C 1/00 36/54
2011/0126428 A1 6/2011 Hazenberg et al.
2011/0197475 A1 8/2011 Weidl et al.
2011/0239486 A1 * 10/2011 Berger ..... A43B 3/24 36/136
2011/0258876 A1 10/2011 Baker et al.
2012/0023686 A1 2/2012 Huffa et al.
2012/0131818 A1 5/2012 Nishiwaki et al.
2012/0233882 A1 9/2012 Huffa et al.
2012/0240428 A1 * 9/2012 Knoll ..... A43B 5/0427 36/50.1
2012/0255201 A1 10/2012 Little
2012/0260526 A1 10/2012 Smith et al.
2013/0212905 A1 8/2013 Hazenberg et al.
2013/0255105 A1 * 10/2013 Bishop ..... A43B 3/126 36/88
2014/0000127 A1 * 1/2014 Tang ..... A43B 3/244 36/101
2014/0033571 A1 * 2/2014 Gillespie ..... A43B 3/24 36/102
2014/0101972 A1 4/2014 Ha
2014/0130372 A1 5/2014 Aveni et al.
2014/0223778 A1 8/2014 Horacek
2014/0223779 A1 * 8/2014 Elder ..... A43C 1/04 36/103
2014/0345160 A1 * 11/2014 Gerber ..... A43B 3/242 36/89
2015/0320141 A1 * 11/2015 Collins ..... A43B 13/023 36/100
2015/0342297 A1 * 12/2015 Garza, Jr. ..... A43B 13/14 482/122
2016/0353835 A1 * 12/2016 Hesterberg ..... A43B 13/141

FOREIGN PATENT DOCUMENTS

DE 19738433 A1 4/1998
DE 19728848 A1 1/1999
EP 0448714 A1 10/1991
EP 0728860 A1 8/1996
EP 0758693 A1 2/1997
EP 1233091 A1 8/2002
FR 2171172 A1 9/1973
FR 2697727 A3 10/1993
GB 538865 A 8/1941
GB 1603487 A 11/1981
JP H06113905 A 4/1994
JP H08109553 A 4/1996
JP 09065908 3/1997
JP H11302943 A 11/1999
JP 2007190351 A 8/2007
NL 7304678 A 10/1974
WO WO-9003744 A1 4/1990
WO WO-0032861 A1 6/2000
WO WO-0231247 A1 4/2002

OTHER PUBLICATIONS

Crocheted Slippers Gladiator Home sandals, http://etsy.com/listing/5079558, 2pp, accessed Mar. 25, 2013.
Dior concepts, Byron Jeffrey, http://www.byronjeffrey.com/55336/881326/portfolio/dior, 4pp, accessed Mar. 25, 2013.
Excerpt of Hannelore Eberle et al., Clothing Technology (Third English ed., Beuth-Verlag GmnH 2002) (book cover and back; pp. 2-3, 83).
International Search Report and Written Opinion in connection with International Application No. PCT/US2014/019542, mailed Jun. 26, 2014.
International Search Report and Written Opinion in connection with International Application No. PCT/US2014/019548, mailed Jun. 26, 2014.
RCD-Online—Design consultation service, Design No. 0000141915-0006, Designed by Dave J. Schenone, Publication Date Aug. 5, 2003, 3pp.
Declaration of Dr. Edward C. Frederick from the US Patent and Trademark Office Inter Partes Review of U.S. Pat. No. 7,347,011, Dated Nov. 28, 2012 (178pp).

(56) References Cited

OTHER PUBLICATIONS

David J. Spencer, Knitting Technology: A Comprehensive Handbook and Practical Guide, Third ed., Woodhead Publishing Ltd., First Published 1983, Pergamon Press, Republished 2001, (413pp).

* cited by examiner

ARTICLE OF FOOTWEAR WITH ADJUSTABLE FITTING SYSTEM

CROSS-REFERENCE TO RELATED APPLICATIONS

This application is a continuation of U.S. patent application Ser. No. 14/039,225, filed Sep. 27, 2013, the disclosure of which is incorporated by reference in its entirety.

BACKGROUND

Field

The following relates to an article of footwear and, more particularly, relates to an article of footwear with an adjustable fitting system.

Description of Related Art

This section provides background information related to the present disclosure which is not necessarily prior art.

Conventional articles of footwear generally include two primary elements, an upper and a sole structure. The upper is secured to the sole structure, and an interior surface of the upper defines a void for comfortably and securely receiving a foot. The sole structure is secured to a lower area of the upper, thereby being positioned between the upper and the ground. In athletic footwear, for example, the sole structure may include a midsole and an outsole. The midsole often includes a polymer foam material that attenuates ground reaction forces to lessen stresses upon the foot and leg during walking, running, and other ambulatory activities. Additionally, the midsole may include fluid-filled chambers, plates, moderators, or other elements that further attenuate forces, enhance stability, or influence the motions of the foot. The outsole is secured to a lower surface of the midsole and provides a ground-engaging portion of the sole structure formed from a durable and wear-resistant material, such as rubber. The sole structure may also include a sockliner positioned within the void and proximal a lower surface of the foot to enhance footwear comfort.

The upper generally extends over the instep and toe areas of the foot, along the medial and lateral sides of the foot and around the heel area of the foot. In some articles of footwear, such as basketball footwear and boots, the upper may extend upward and around the ankle to provide support or protection for the ankle. Access to the void on the interior of the upper is generally provided by an ankle opening in a heel region of the footwear. A lacing system is often incorporated into the upper to adjust the fit of the upper, thereby permitting entry and removal of the foot from the void within the upper. The lacing system also permits the wearer to modify certain dimensions of the upper, particularly girth, to accommodate feet with varying dimensions. In addition, the upper may include a tongue that extends under the lacing system to enhance adjustability of the footwear, and the upper may incorporate a heel counter to limit movement of the heel.

SUMMARY

An article of footwear is disclosed that includes an upper that defines a void for receiving a foot. The article of footwear also includes a flexible sole structure that is coupled to the upper. Also, the article of footwear includes a fitting system. The fitting system includes an upper member that is supported by the upper. The fitting system also includes a strand guide that is supported by the sole structure. The strand guide is flexible and configured to flex in concert with the sole structure between a first position and a second position. The strand guide has a guide surface. The fitting system further includes a tensioning system with a flexible strand that is configured to bias the upper member toward the strand guide. The flexible strand has a first section coupled to the upper member and a second section extending through the sole structure. The second section abuts the guide surface. The second section is configured to slide across the guide surface as a result of flexure of the strand guide between the first position and the second position. The first section and the upper member are configured to move relative to the sole structure as a result of sliding of the second section across the guide surface.

Additionally, an article of footwear having a medial side, a lateral side, and a longitudinal axis is disclosed. The article of footwear includes an upper that defines a void for receiving a foot. The article of footwear also includes a flexible sole structure that is coupled to the upper. Moreover, the article of footwear includes a fitting system. The fitting system includes an upper member that is supported by the upper and a strand guide that is supported by the sole structure. The strand guide is flexible and configured to flex in concert with the sole structure between a first position and a second position. The fitting system also includes a tensioning system with at least one flexible strand that is configured to bias the upper member toward the strand guide. The flexible strand has a medial portion, a lateral portion, and a central portion. The medial portion is coupled to the upper member at the medial side. The lateral portion is coupled to the upper member at the lateral side. The central portion extends through the sole structure and abuts the strand guide. The central portion is configured to slide across the strand guide as a result of flexure of the strand guide between the first position and the second position.

Still further, an article of footwear having a longitudinal axis extending between a heel region and a forefoot region of the article of footwear is disclosed. The article of footwear includes an upper that defines a void for receiving a foot. The article of footwear also includes a sole structure that is coupled to the upper. Additionally, the article of footwear includes a fitting system. The fitting system includes an upper member that is supported by the upper. The fitting system also includes a strand guide that is supported by the sole structure. The strand guide is flexible and configured to flex in concert with the sole structure between a first position and a second position. The strand guide includes a longitudinal member that extends along the longitudinal axis of the article of footwear. The strand guide also includes a transverse member that extends transversely from the longitudinal member. The strand guide also includes a guide surface that extends continuously across each of the longitudinal member and the transverse member. The fitting system further includes a tensioning system with at least one flexible strand. The strand includes a first section, a second section, a third section, and a fourth section. The first section, the second section, the third section, and the fourth section are arranged continuously in succession along a longitudinal axis of the strand. The first section is attached to the heel region, the second section extends through the sole structure along the guide surface of the longitudinal member, the third section extends transversely from the second section through the sole structure and along the guide surface of the transverse member, and the fourth section extends from the third section and is attached to the upper member.

Other systems, methods, features and advantages of the present disclosure will be, or will become, apparent to one of ordinary skill in the art upon examination of the following figures and detailed description. It is intended that all such additional systems, methods, features and advantages be included within this description and this summary, be within the scope of the present disclosure, and be protected by the following claims.

BRIEF DESCRIPTION OF THE DRAWINGS

The present disclosure can be better understood with reference to the following drawings and description. The components in the figures are not necessarily to scale, emphasis instead being placed upon illustrating the principles of the present disclosure. Moreover, in the figures, like reference numerals designate corresponding parts throughout the different views.

FIGS. 26 and 27 are rear views of the article of footwear and fitting system according to additional embodiments of the present disclosure, wherein FIG. 26 shows the fitting system being tightened and FIG. 27 shows the fitting system being loosened;

DETAILED DESCRIPTION

The following discussion and accompanying figures disclose a variety of concepts relating to articles of footwear with fitting systems that adjustably fit the footwear to the wearer's loot. Stated differently, the fitting systems can tighten and secure the footwear to the foot, and the fitting systems can loosen and release the footwear from the foot as will be discussed in detail. The fitting systems can compress the footwear against the wearer's foot in some embodiments so as to closely and comfortably conform the footwear to the foot. The fitting systems can also adjust the fit of the footwear while the wearer's foot moves and flexes while walking, running, jumping, or otherwise moving. As a result, the footwear can be very comfortable to wear, the footwear can enhance the wearer's ability to run and jump, and the footwear can provide additional benefits that will be discussed in detail below.

Figure 1:
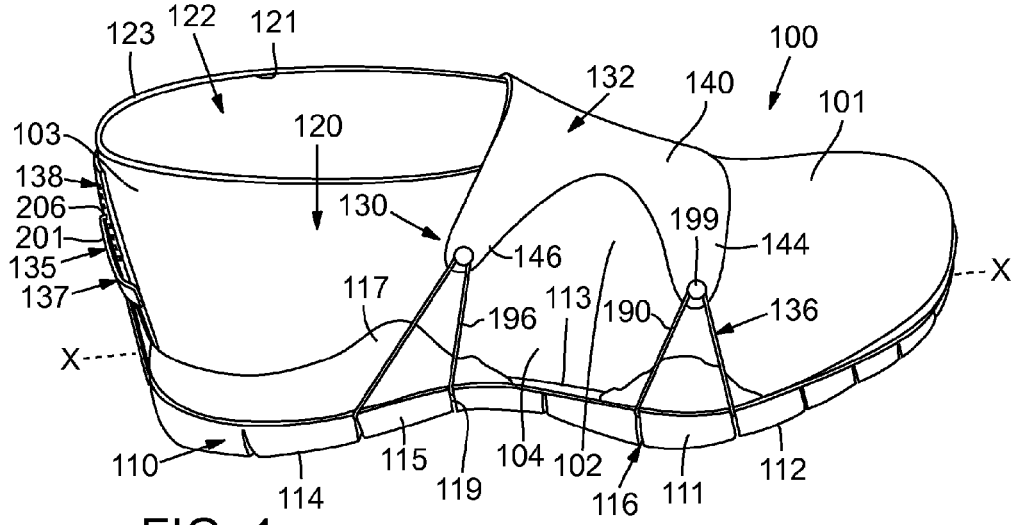
FIG. 1 is a lateral view of an article of footwear with a compressive fitting system according to exemplary embodiments of the present disclosure.
Figure 2:
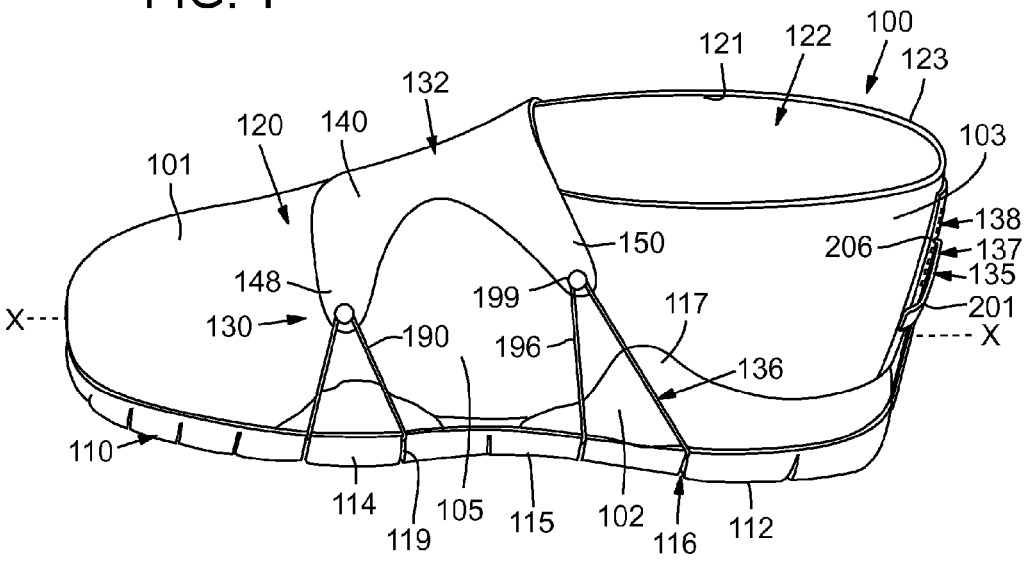
FIG. 2 is a medial view of the article of footwear of FIG. 1.
Figure 3:
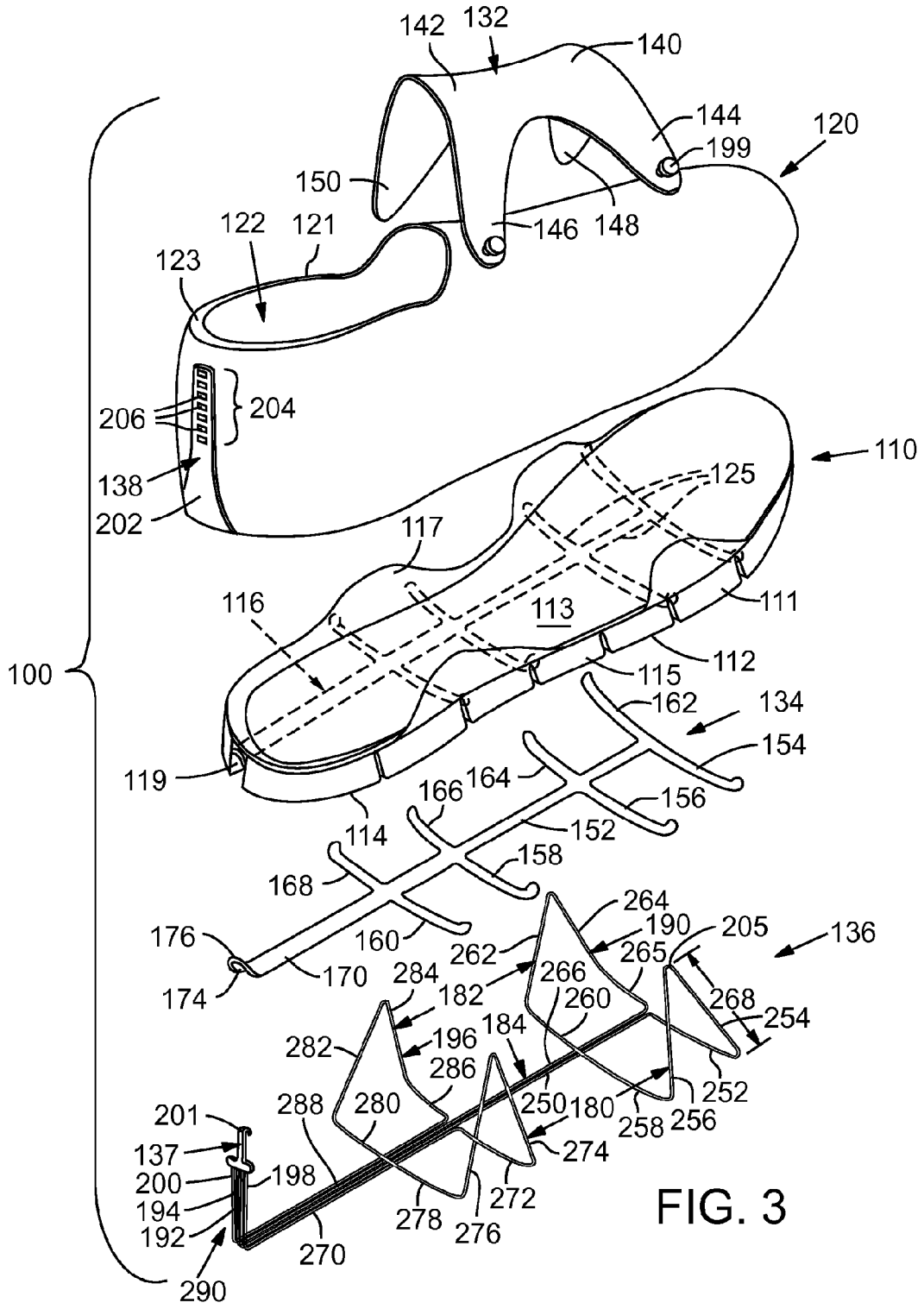
FIG. 3 is an exploded perspective view of the article of footwear of FIG. 1.

FIGS. 1 through 3 illustrate exemplary embodiments of an article of footwear 100, also referred to simply as footwear 100. In some embodiments, article of footwear 100 may include a sole structure 110 and an upper 120. Although footwear 100 is illustrated as having a general configuration suitable for running, concepts associated with footwear 100 may also be applied to a variety of other athletic footwear types, including baseball shoes, basketball shoes, cycling shoes, football shoes, tennis shoes, soccer shoes, training shoes, walking shoes, and hiking boots, for example. The concepts may also be applied to footwear types that are generally considered to be non-athletic, including dress shoes, loafers, sandals, and work boots. Accordingly, the concepts disclosed with respect to footwear 100 may be applied to a wide variety of footwear types.

For reference purposes, footwear 100 may be divided into three general regions, namely, a forefoot region 101, a midfoot region 102, and a heel region 103 as shown in FIGS. 1 and 2. These regions 101, 102, 103 can be spaced apart generally along a longitudinal axis X of footwear 100. Forefoot region 101 generally includes portions of footwear 100 corresponding with the toes and the joints connecting the metatarsals with the phalanges. Midfoot region 102 generally includes portions of footwear 100 corresponding with an arch area of the foot. Heel region 103 generally corresponds with rear portions of the foot, including the calcaneus bone. Footwear 100 also includes a lateral side 104 and a medial side 105, which are spaced on opposite sides of axis X, and which extend through each of forefoot region 101, midfoot region 102, and heel region 103 and correspond with opposite sides of footwear 100. More particularly, lateral side 104 corresponds with an outside area of the foot that faces away from the other foot, and medial side 105 corresponds with an inside area of the foot that faces toward the other foot. Forefoot region 101, midfoot region 102, and heel region 103 and lateral side 104, medial side 105 are not intended to demarcate precise areas of footwear 100. Rather, forefoot region 101, midfoot region 102, and heel region 103 and lateral side 104, medial side 105 are intended to represent general areas of footwear 100 to aid in the following discussion. Additionally, while the terms forefoot region 101, midfoot region 102, heel region 103, lateral side 104, and medial side 105 can be applied to footwear 100, these terms can also indicate corresponding areas of the sole structure 110, the upper 120, and individual elements of these structures.

Exemplary embodiments of sole structure 110 are shown FIGS. 1-3. Sole structure 110 is secured to upper 120 and extends between the foot and the ground when footwear 100 is worn. Thus, sole structure 110 can define a ground engaging surface 114. Sole structure 110 can also include an upper engaging surface 113 that is coupled to sole structure 110. Furthermore, sole structure 110 can include a side surface 115 that extends between ground engaging surface 114 and upper engaging surface 113. Side surface 115 can define a periphery of sole structure 110. As will be discussed, sole structure 110 can be flexible. For example, sole structure 110 can bend along any suitable axis when the wearer runs, jumps, or otherwise moves the foot within footwear 100.

In some embodiments, the sole structure 110 can include a midsole 111 and an outsole 112. In additional embodiments, the sole structure 110 can include a sockliner that is disposed within upper 120 to extend under a lower surface of the foot and to enhance the comfort of footwear 100.

Midsole 111 can define upper engaging surface 113 and can be secured to a lower surface of upper 120. Midsole 111 may be formed from a compressible polymer foam element, such as a polyurethane or ethylvinylacetate foam, that attenuates ground reaction forces to provide cushioning when compressed between the foot and the ground during walking, running, or other ambulatory activities. In additional embodiments, midsole 111 may incorporate plates, moderators, fluid-filled chambers, lasting elements, or motion control members that further attenuate forces, enhance stability, or influence the motions of the foot.

As shown in FIG. 3, upper engaging surface 113 can include one or more projections 117 that extend generally toward upper 120. For instance, projections 117 can be contoured to support and/or shape corresponding portions of upper 120. Projections 117 in FIG. 3, for example, are positioned about heel region 103, medial region 102, and forefoot region 101. Projections 117 can also be shaped to cushion and/or resist medial, lateral, rearward, and forward movements of the wearer's foot within upper 120.

Outsole 112 can be secured to a lower surface of midsole 111 and may be formed from a wear-resistant rubber material that is textured to impart traction. Outsole 112 can also include a plurality of durable pads that are spaced apart on the lower surface of midsole 111. Thus, outsole. 112 can at least partially define ground engaging surface 114 to provide traction to footwear 100.

Sole assembly 110 can also include a recess 116. For instance, recess 116 can extend upward from ground engaging surface 114. Recess 116 can have any suitable shape and dimension. Recess 116 can extend from ground engaging surface 114 and into outsole 112. In some embodiments, recess 116 can also extend from ground engaging surface 114, through outsole 112, and into midsole 111. Features of recess 116 will be discussed in further detail below.

Embodiments of upper 120 are also shown in FIGS. 1-3. Upper 120 can define a void 122 within footwear 100 for receiving and securing a foot relative to sole structure 110. Upper 120 can be shaped to accommodate the wearer's foot and can extend along a lateral side of the foot, along a medial side of the foot, over the foot, around the heel, and under the foot in some embodiments.

Access to the void 122 can be provided by an ankle opening 121 located in at least heel region 103. The size of ankle opening 121 can be defined by a rim 123 through which the wearer's foot enters and exits upper 120.

In some embodiments, upper 120 can be made from a lightweight and flexible material. For instance, upper 120 can be made from fabric, breathable mesh, or other suitable material.

As shown in FIGS. 1-4, article of footwear 100 can further include a fitting system 130. Fitting system 130 can secure footwear 100 to the wearer's foot as will be discussed. For instance, fitting system 130 can allow the wearer to selectively tighten footwear 100 to the wearer's foot, and fitting system 130 can allow the wearer to selectively loosen footwear 100 from the wearer's foot. Fitting system 130 can also automatically adjust the fit of the footwear 100 such that footwear 100 comfortably conforms to the wearer's foot as the foot flexes, extends, and moves within upper 120.

It will be appreciated that fitting system 130 illustrated in FIGS. 1-4 and described below are merely exemplary embodiments of the present disclosure. Thus, fitting system 130 could vary in many ways without departing from the scope of the present disclosure.

Embodiments of fitting system 130 will now be discussed in detail. In some embodiments, fitting system 130 can generally include an upper member 132, a strand guide 134, and a tensioning system 136 as shown in FIGS. 1-4. Upper member 132 can be disposed on, supported by, coupled to, and/or attached to upper 120. Strand guide 134 can be disposed on, supported by, coupled to, and/or attached to sole structure 110. Moreover, tensioning system 136 can extend between and operably couple upper member 132 and strand guide 134. As will be discussed, tension within tensioning system 136 can cause upper member 132 and strand guide 134 to be biased toward each other to fit footwear 100 to the wearer's foot.

In some embodiments, fitting system 130 can further include an adjustment device 135 that allows tension in the tensioning system 136 to be selectively adjusted by the wearer. Accordingly, adjustment device 135 can allow the user to selectively adjust the fit or the compressive load applied by the fitting system 130 to the wearer's foot as will be discussed.

Upper member 132 can have any suitable shape and size. For instance, as shown in FIGS. 1-4, upper member 132 can include a relatively thin panel 140 of flexible material. In some embodiments, panel 140 can include a knitted or woven fabric, leather, or other suitable material. Panel 140 can also be supported in any suitable position relative to upper 120. For instance, panel 140 can overlap midfoot region 102 of upper 120 and can extend between medial side 105 and lateral side 104 of upper 120. Panel 140 can also be disposed immediately forward of ankle opening 121 and can be substantially centered with respect to ankle opening 121. As such, panel 140 can effectively distribute loads over the midfoot region of the wearer's foot.

It will be appreciated that although panel 140 covers an outer surface of upper 120 and is exposed in the illustrated embodiments, panel 140 could be differently arranged with respect to upper 120. For example, panel 140 could be overlapped by portions of upper 120. Panel 140 also could be at least partially enclosed by upper 120 in some embodiments.

As shown in the embodiments of FIG. 3, panel 140 can have a main body 142 and at least one projection that extends from main body 142. More specifically, panel 140 can include a forward lateral projection 144, a rear lateral projection 146, a forward medial projection 148, and a rear medial projection 150. Projection 144 and projection 146 can extend from main body 142 toward lateral side 104 of footwear 100. Projection 148 and projection 150 can extend from main body 142 toward medial side 105. Projection 144 and projection 146 can also be spaced apart longitudinally along axis X of footwear 100. Likewise projection 148 and projection 150 can be similarly spaced longitudinally along axis X. Accordingly, panel 140 can be generally butterfly-shaped and symmetrical, and panel 140 can substantially centered over footwear 100.

Embodiments of strand guide 134 will now be discussed. Strand guide 134 can also have any suitable shape and size. Strand guide 134 can also be coupled to sole structure 110 and can extend through sole structure 110. Moreover, strand guide 134 can be flexible and can flex in concert with sole structure 110. As such, flexure of strand guide 134 can cause sole structure 110 to flex. Also, flexure of sole structure 110 can cause strand guide 134 to flex. Furthermore, strand guide 134 can be coupled to tensioning system 136 and can couple tensioning system to sole structure 110. As such, tension of tensioning system 136 can cause flexure of strand guide 134. Still further, flexure of strand guide 134 can cause a change in tension of tensioning system 136. Strand guide 134 can further reinforce sole structure 110 and distribute forces of the tensioning system 136 on sole structure 110. As such, sole structure 110 is unlikely to be damaged by tensioning system 136. Moreover, strand guide 134 can guide movement of tensioning system 136 relative to sole structure 110 in some embodiments.

As shown in FIGS. 3-6, strand guide 134 can include a longitudinal member 152 with at least one transverse member extending transversely from longitudinal member 152. Also, strand guide 134 can include a plurality of transverse members. For example, strand guide 134 can include a first forward lateral transverse member 154, a second forward lateral transverse member 156, a first rear lateral transverse member 158, and a second rear lateral transverse member 160 that each extend transversely from longitudinal member 152. Strand guide 134 can further include a first forward medial transverse member 162, a second forward medial transverse member 164, a first rear medial transverse member 166, and a second rear medial transverse member 168 that each extend transversely from longitudinal member 152. Transverse member 162, transverse member 164, transverse member 166, and transverse member 168 can each extend in a direction opposite that of transverse member 154, transverse member 156, transverse member 158, and transverse member 160. As shown in the illustrated embodiments, first forward lateral transverse member 154 and first forward medial transverse member 162 can be substantially aligned. Likewise, second forward lateral transverse member 156 and second forward medial transverse member 164 can be substantially aligned, first rear lateral transverse member 158 and first rear medial transverse member 166 can be substantially aligned, and second rear lateral transverse member 160 and second rear medial transverse member 168 can be substantially aligned. Moreover, an end 170 of longitudinal member 152 can extend from second rear lateral transverse member 160 and second rear medial transverse member 168.

Figure 23:
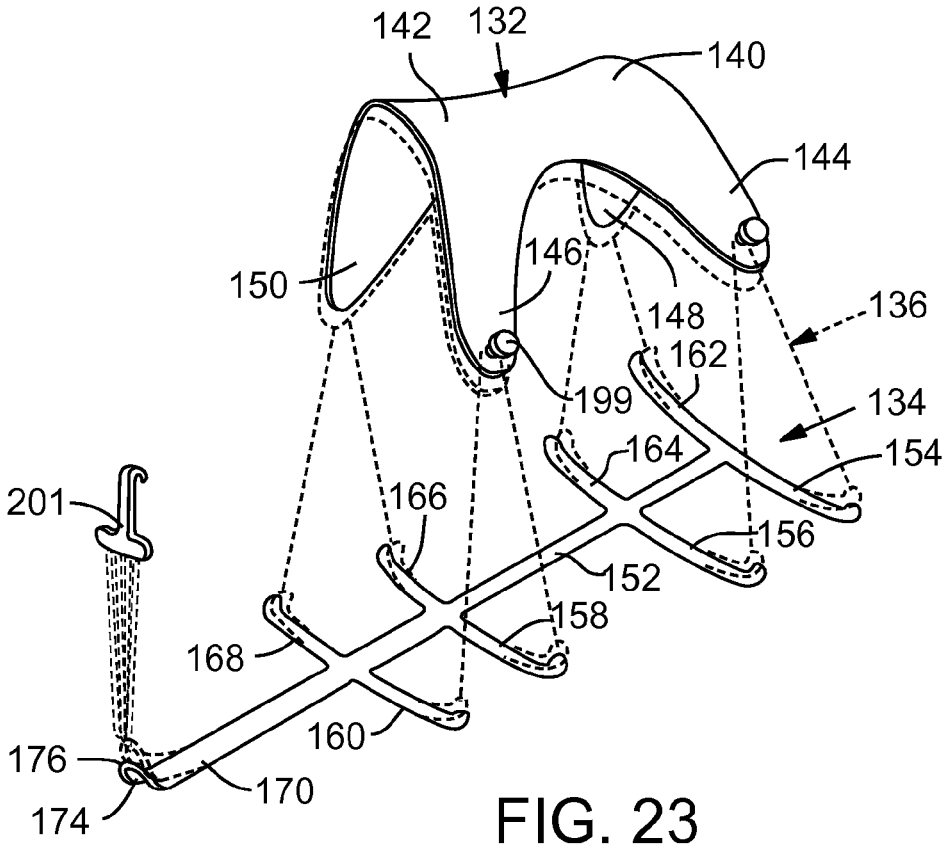
FIG. 23 is a perspective view of the compressive fitting system of FIG. 1 with the upper member and strand guide shown in a neutral position in solid lines, with the upper member and the strand guide shown in a compressed position in phantom lines, and with the tensioning system shown with broken lines.

One or more of transverse member 154, transverse member 156, transverse member 158, transverse member 160, transverse member 162, transverse member 164, transverse member 166, and transverse member 168 can be integrally attached to longitudinal member 152. Also, strand guide 134 can be made out of any suitable material, such as polymeric or metallic material. Additionally, strand guide 134 can resiliently flexible as represented in FIGS. 13, 17-20, and 23. For example, as shown in FIG. 23, strand guide 134 is shown in a neutral position in solid lines, and strand guide 134 is shown in a resiliently flexed position in phantom lines. In some embodiments, strand guide 134 can be resiliently flexed or bent from the neutral position to the flexed position, and upon removal of the bending load, the strand guide 134 can resiliently recover back to the neutral position.

Figure 5:
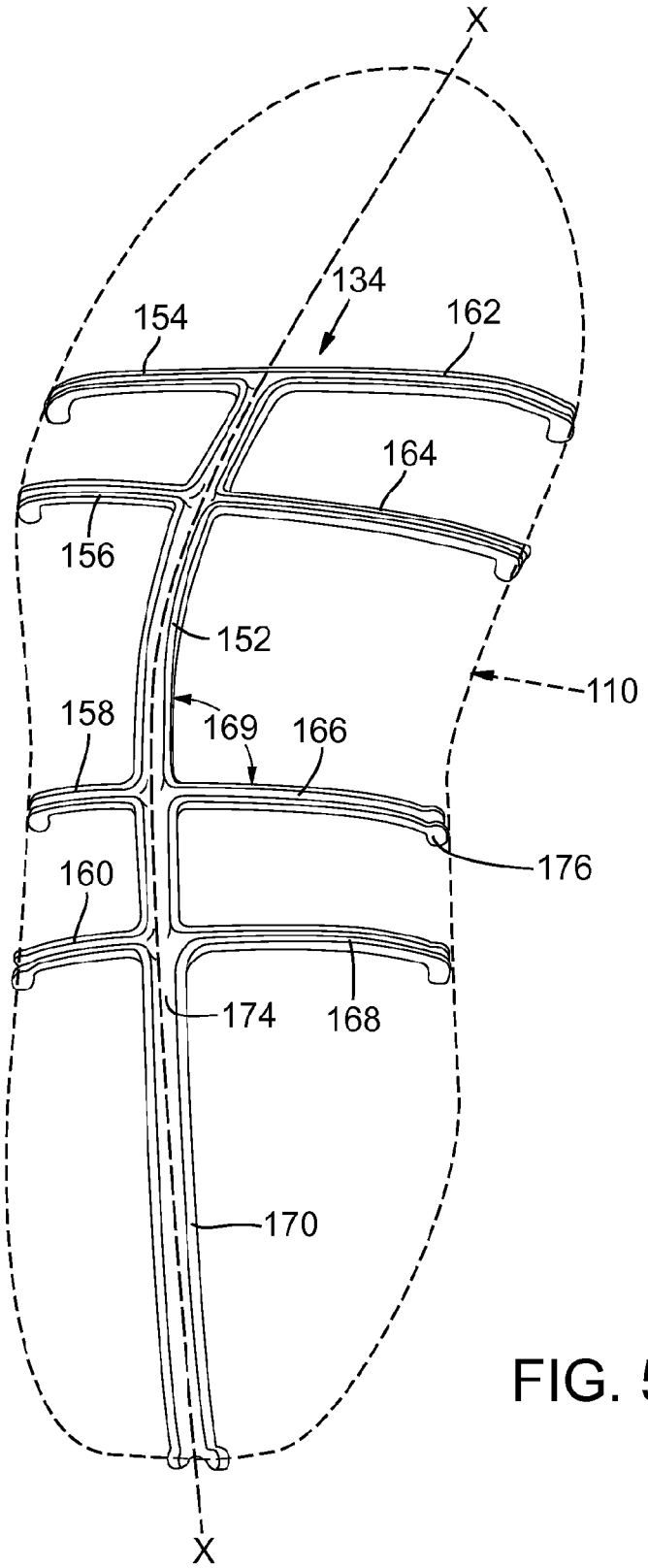
FIG. 5 is a bottom view of a strand guide of the compressive fitting system of FIG. 1 with a peripheral edge of the sole structure shown in phantom.

As shown in the embodiments of FIG. 5, longitudinal member 152 can be curved longitudinally. Also, as shown in FIG. 5, transverse member 154, transverse member 156, transverse member 158, transverse member 160, transverse member 162, transverse member 164, transverse member 166, and transverse member 168 can extend transversely from longitudinal member 152 at a respective angle, one of which is indicated at reference numeral 169. It will be appreciated that angles 169 between longitudinal member 152 and each of transverse members can have any suitable value.

Furthermore, strand guide 134 can include one or more upturned ends 176. For example, transverse member 154, transverse member 156, transverse member 158, transverse member 160, transverse member 162, transverse member 164, transverse member 168, and end 170 can each include a respective upturned end 176, which is spaced from longitudinal member 152.

Figure 6:
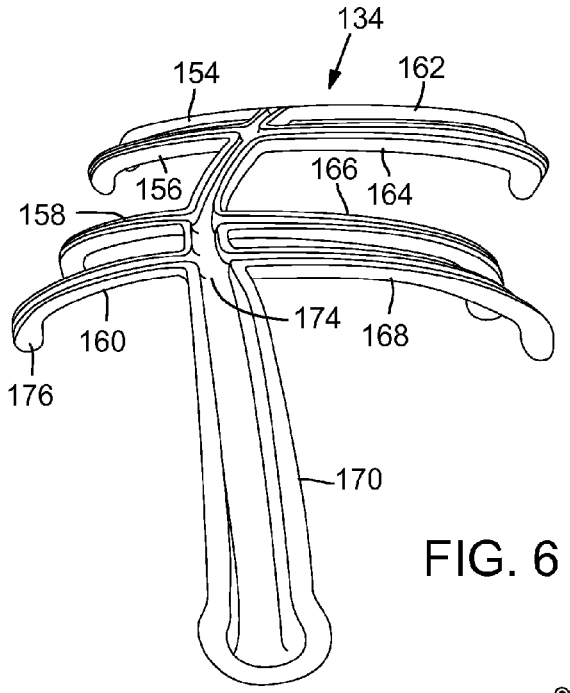
FIG. 6 is an inverted rear view of the strand guide of FIG. 5.

Still further, as shown in FIGS. 5, 6 and 11-13, strand guide 134 can define a guide surface 174. Guide surface 174 can be shaped, sized, and otherwise configured to receive tensioning system 136 to thereby operably couple the tensioning system 136 to strand guide 134. For example, guide surface 174 can be defined by an open groove, a hollow tube, or other aperture included on strand guide 134. In the illustrated embodiments, for example, guide surface 174 is defined by a groove on an underside of strand guide 134. The guide surface 174 can be contoured and concave in cross section. For example, guide surface 174 can be U-shaped in cross section as shown in FIG. 6. Moreover, guide surface 174 can extend and branch continuously along longitudinal member 152, transverse members 154, transverse member 156, transverse member 158, transverse member 160, transverse member 162, transverse member 164, transverse member 166, and transverse member 168.

Strand guide 134 can be operably coupled and supported by sole structure 110 in any suitable fashion. For example, as shown in FIG. 3, strand guide 134 can be received within recess 116 of sole structure 110. Thus, in some embodiments, recess 116 can be shaped and sized to match the shape and size of strand guide 134. Also, in some embodiments, strand guide 134 can be held within recess 116 via friction, via an interference fit, via fasteners, or other suitable attachment device. Thus, strand guide 134 can be exposed through the ground engaging surface 114. In additional embodiments, strand guide 134 can be substantially enclosed within sole structure 110. For example, ground engaging surface 114 can substantially cover strand guide 134, and ends 176 of strand guide 134 can be exposed through respective openings in sole structure 110. Ends 176 can extend slightly outward from sole structure 110 or can be disposed inward relative to sole structure 110. The position of ends 176 can also be dependent on the anatomy of the wearer's foot, the size of the sole structure 110, or other factors.

Additionally, strand guide 134 can be disposed relative to sole structure 110 in any suitable location when coupled to sole structure 110. As shown in the embodiment of FIG. 5 where sole structure 110 is shown in phantom, strand guide 134 can be substantially centered on sole structure 110 and disposed such that longitudinal member 152 can extend generally along longitudinal axis X. Also, lateral transverse member 154, lateral transverse member 156, lateral transverse member 158, and lateral transverse member 160 can extend laterally toward lateral side 104. Medial transverse member 162, medial transverse member 164, medial transverse member 166, and medial transverse member 168 can extend medially toward medial side 105. Upturned ends 176 of transverse member 154, transverse member 156, transverse member 158, and transverse member 160 can be disposed adjacent side surface 115 of sole structure 110. Also, ends 176 can be exposed through sole openings 119 that are defined by side surface 115 of sole structure 110. Upturned ends 176 can be turned upward slightly towards upper 120 as shown.

Embodiments of tensioning system 136 will now be discussed with reference to FIGS. 1-4 and 7. As mentioned above, tensioning system 136 can operably couple upper member 132 and strand guide 134. As such, upper member 132 can be biased toward strand guide 134 to fit article of footwear 100 to the wearer's foot. Moreover, tensioning system 136 can allow footwear 100 to adjust to the wearer's foot when it flexes, extends, and moves within upper 120. Tensioning system 136 can also be highly flexible and moveable relative to upper 120 and/or sole structure 110 to thereby accommodate the high degree movement of the wearer's foot.

Tensioning system 136 can include one or more flexible strands. In some embodiments, tensioning system 136 can include a first strand 190 and a second strand 196. The strand 190 and strand 196 can be a cable, a rope, a wire, a cord, braided wires, a yarn, a monofilament, a composite filament including multiple wound or braided filaments, a chain, or other suitable elongate and flexible structures. Also, strand 190 and/or strand 196 can have a substantially fixed length. In additional embodiments, strand 190 and/or strand 196 can be resiliently stretchable and extendable in length. However, it will be appreciated that tensioning system 136 can include any suitable number of strands and/or tensioning system 136 can include alternative structure without departing from the scope of the present disclosure.

Tensioning system 136 can be arranged in any suitable fashion with respect to upper 120, sole structure 110, and strand guide 134. Stated differently, strand 190 and strand 196 can extend over, through, and under any suitable portion of upper 120, sole structure 110, and strand guide 134.

Figure 4:
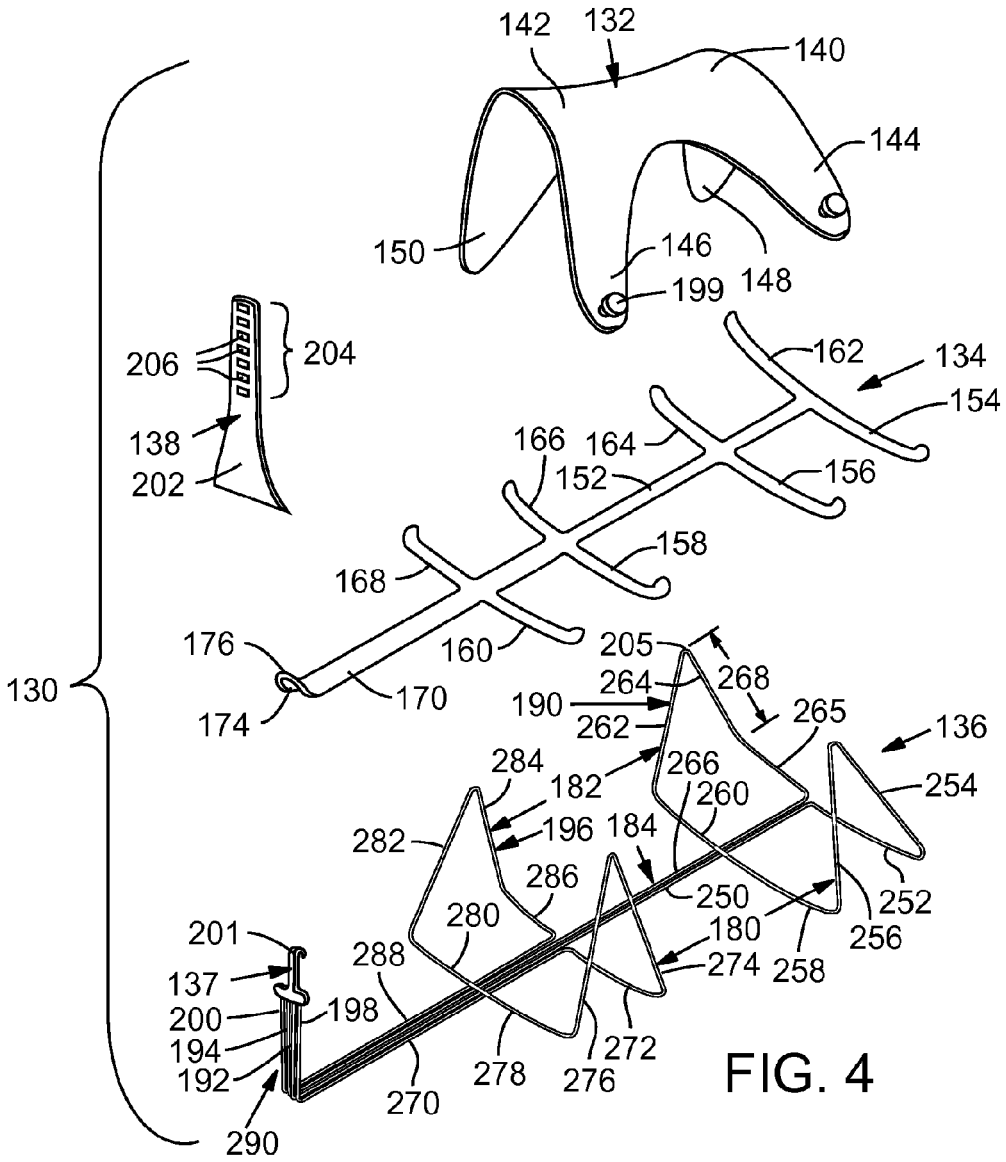
FIG. 4 is an exploded view of the compressive fitting system of the article of footwear of FIG. 1.
Figure 7:
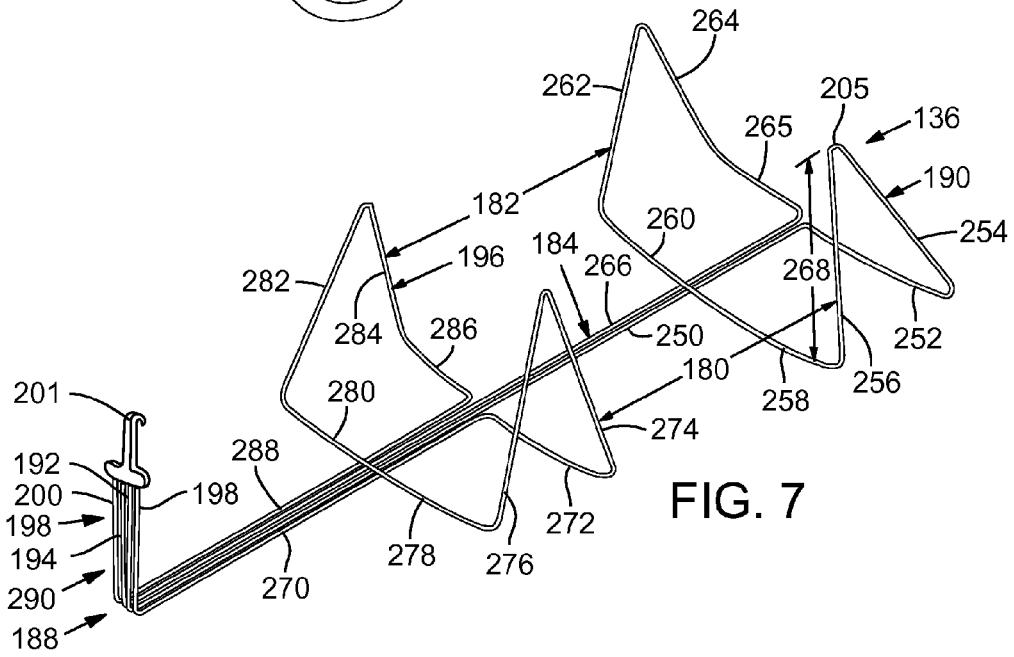
FIG. 7 is a perspective view of a tensioning system of the compressive fitting system of the article of footwear of FIG. 1.

Tensioning system 136 can be cooperatively defined by first strand 190 and second strand 196. For purposes of discussion, the tensioning system 136 will be discussed as being divided into a plurality of portions, sections, or segments. For example, tensioning system 136 can include a central portion 184, a medial portion 182, and a lateral portion 180 as indicated in FIGS. 4 and 7. Central portion 184 of tensioning system 136 can be received and guided by strand guide 134 for movement that is directed substantially parallel to the ground engaging surface 114. Medial portion 182 can branch from central portion 184 and can be connected to the upper member 132 on the medial side 105 of footwear 100. Lateral portion 180 can branch from central portion 184 and can be connected to upper member 132 on the lateral side 104 of footwear 100. First strand 190 and second strand 196 can collectively define each of central portion 184, medial portion 182, and lateral portion 180 of tensioning system 136 in some embodiments.

Tensioning system 136 can also be connected to heel region 103 of footwear 100 on the upper 120 and/or sole structure 110. For example, a tail portion 290 of tensioning system 136 can be attached to heel region 103 and can be attached to central portion 184 of tensioning system 136. In some embodiments, tail portion 290 can be fixedly attached to heel region 103. In other embodiments, tail portion 290 can be removably attached to heel region 103.

First strand 190 will now be discussed in greater detail. First strand 192 can be divided longitudinally into a plurality of sections, portions, divisions, or segments. The following discussion of the different longitudinal sections of the first strand 190 is merely exemplary, and it will be appreciated that first strand 192 can be divided longitudinally into any number of sections.

For example, in the embodiments shown in FIGS. 3, 4, and 7, a first end 192 of first strand 190 can extend from heel region 103 and vertically downward. A first horizontal section 250 of first strand 190 can be received in end 170 of longitudinal member 152 and can continuously extend forward along longitudinal member 152 toward forefoot region 101. A second horizontal section 252 of first strand 190 can extend along first forward lateral transverse member 154 toward the lateral side 104. From end 176 of transverse member 154, a third vertical section 254 of first strand 190 can extend vertically upward toward upper 120 and upper member 132 to connect the first strand 190 to forward lateral projection 144 of upper member 132. A fourth vertical section 256 of first strand 190 can extend back vertically downward from forward lateral projection 144 toward sole structure 110. A fifth horizontal section 258 can extend from end 176 of second forward lateral transverse member 156, first strand 190 can cross over longitudinal member 152, and a sixth horizontal section 260 of first strand 190 can extend along second forward medial transverse member 164. Moreover, a seventh vertical section 262 of first strand 190 can extend from end 176 of transverse member 164 upward toward upper 120 and upper member 132 to connect the first strand 190 to forward medial projection 148 of upper member 132. An eighth vertical section 264 can extend back vertically downward from forward medial projection 148 toward sole structure 110. A ninth horizontal section 265 can extend along first forward medial transverse member 162 toward longitudinal member 152. Additionally, a tenth horizontal section 266 can extend longitudinally along longitudinal member 152. From end 176 of longitudinal member 152, a second end 194 of first strand 190 can extend upward and terminate at heel region 103.

It will be appreciated that section 250, section 266, section 252, section 258, section 260, and section 265 can cooperate to at least partially define the central portion 184 of the tensioning system 136 in the illustrated embodiments. It will also be appreciated that section 254 and section 256 can cooperate to at least partially define the lateral portion 180 of tensioning system 136. Moreover, section 262 and section 264 can cooperate to at least partially define the medial portion 182 of tensioning system 136.

Furthermore, section 254 and section 256 can be disposed at an angle relative to each other and can be arranged in an inverted "V" shape as shown in FIGS. 3, 4, and 7. Likewise, section 262 and section 264 can also be disposed at an angle relative to each other and can be arranged in an inverted "V" shape.

Second strand 196 will now be discussed in greater detail. Second strand 196 can be considered to have a plurality of sections, portions, divisions, or segments. As discussed above with respect to first strand 190, the second strand 196 can be divided longitudinally into any number of sections.

Specifically, in the embodiments shown in FIGS. 3, 4, and 7, a first end 198 of second strand 196 can extend from heel region 103 and vertically downward. A first horizontal section 270 of second strand 196 can be received in end 170 of longitudinal member 152 and can continuously extend forward along longitudinal member 152 toward forefoot region 101. A second horizontal section 272 of second strand 196 can extend along first rear lateral transverse member 158 toward the lateral side 104. From end 176 of transverse member 158, a third vertical section 274 of second strand 196 can extend vertically upward toward upper 120 and upper member 132 to connect the second strand 196 to rear lateral projection 146 of upper member 132. A fourth vertical section 276 of second strand 196 can extend back vertically downward from rear lateral projection 146 toward sole structure 110. A fifth horizontal section 278 can extend from end 176 of second rear lateral transverse member 160, second strand 196 can cross over longitudinal member 152, and a sixth horizontal section 280 of second strand 196 can extend along second rear medial transverse member 168. Moreover, a seventh vertical section 282 of second strand 196 can extend from end 176 of transverse member 168 upward toward upper 120 and upper member 132 to connect the second strand 196 to rear medial projection 150 of upper member 132. An eighth vertical section 284 can extend back vertically downward from rear medial projection 150 toward sole structure 110. A ninth horizontal section 286 can extend along first rear medial transverse member 166 toward longitudinal member 152. Additionally, a tenth horizontal section 288 can extend longitudinally along longitudinal member 152. From end 176 of longitudinal member 152, a second end 200 of second strand 196 can extend upward and terminate at heel region 103.

It will be appreciated that section 270, section 272, section 278, section 286, section 280, and section 288 can cooperate to at least partially define the central portion 184 of the tensioning system 136 in the illustrated embodiments. It will also be appreciated that section 274 and section 276 can cooperate to at least partially define the lateral portion 180 of tensioning system 136. Moreover, section 284 and section 282 can cooperate to at least partially define the medial portion 182 of tensioning system 136.

Furthermore, section 274 and section 276 can be disposed at an angle relative to each other and can be arranged in an inverted "V" shape as shown in FIGS. 3, 4, and 7. Likewise, section 284 and section 282 can also be disposed at an angle relative to each other and can be arranged in an inverted "V" shape.

It will be appreciated that strand 190 and strand 196 could be routed in any suitable way to couple upper member 132 and strand guide 134. It will also be appreciated that first strand 190 and second strand 196 could be braided together or otherwise joined together in some embodiments. Moreover, it will be appreciated that tensioning system 136 could include more or less strands than those in the illustrated embodiments.

Strand 190 and strand 196 can be attached to upper member 132 in any suitable fashion. For example, upper member 132 can include a plurality of fasteners 199 for attaching strand 190 and/or strand 196 to upper member 132. The fasteners 199 can be disposed on respective ones of projection 144, projection 146, projection 148, and projection 150. The fasteners 199 can be of any suitable type, such as pegs, to which the strand 190 and strand 196 are attached. In additional embodiments, fasteners 199 can include eyelets, grommets, hooks, or other fastening devices for attaching to the strand 190 and/or strand 196. Fasteners 199 could also be attached to strand 190 or strand 196 for attaching to upper member 132.

Figure 8:
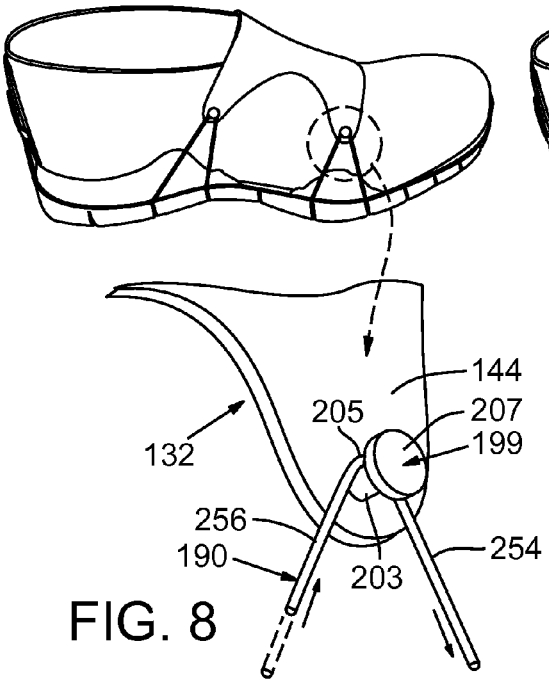
FIGS. 8 and 9 are perspective views of portions of the tensioning system and upper member of the compressive fitting system of FIG. 1.
Figure 9:
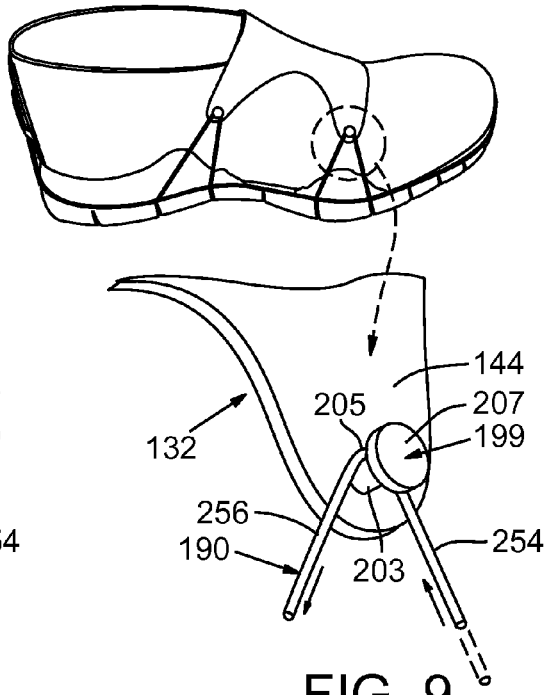
Figure 10:
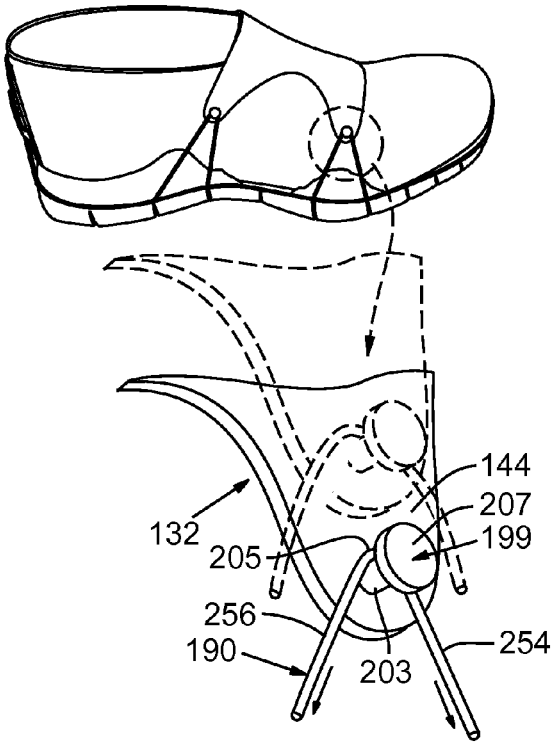
FIG. 10 is a perspective view of the tensioning system shown pulling the upper member of the compressive fitting of FIG. 1 toward the sole structure.

For example, as shown in FIGS. 8, 9, and 10 a vertex 205 of strand 190 can be defined between section 254 and section 256, and vertex 205 can turn over a base 203 of fastener 199 to attach strand 190 to projection 144 of upper member 132. Fasteners 199 can also include an enlarged head 207 that can secure vertex 205 to upper member 132. First strand 190 can be similarly attached at projection 148 of upper member 132, and second strand 196 can be similarly attached at projection 146 and projection 150 of upper member 132.

Also, as shown in FIGS. 8 and 9, first strand 190 can slide longitudinally over base 203 of fastener 199. By comparing FIG. 8 and FIG. 9, it will be apparent that strand 190 can slide in either direction over base 203 of fastener 199 with respect to the longitudinal axis of strand 190. It will be appreciated that second strand 196 can be similarly attached to the other fasteners 199. Thus, strand 190 and strand 196 can be movably attached to upper member 132 at respective locations defined by fasteners 199. Stated differently, strand 190 can slide along the longitudinal axis of strand 190 relative to upper member 132 and, yet, still remain attached to upper member 132. Likewise, strand 196 can slide along the longitudinal axis of strand 196 relative to upper member 132 and, yet, still remain attached to upper member 132.

Moreover, as shown in FIG. 10, tension of first strand 190 can increase to pull upper member 132 toward sole structure 110 and strand guide 134. Stated differently, the first strand 190 can pull upper member 132 from the position shown in phantom in FIG. 10 to the position shown in solid lines in FIG. 10. In contrast, tension of first strand 190 can decrease to allow upper member 132 to move away from sole structure 110 and strand guide 134. It will also be appreciated that tension of second strand 196 can increase to similarly pull upper member 132 toward sole structure 110 and strand guide 134. Furthermore, it will be appreciated that tension of second strand 196 can decrease to allow upper member 132 to move away from sole structure 110 and strand guide 134. Accordingly, increasing tension in tensioning system 136 can pull the upper member 132 and the upper 120 toward the wearer's foot, and decreasing tension in tensioning system 136 can release the upper member 132 and the upper 120 from the wearer's foot.

Additionally, strand 190 and strand 196 can be attached to strand guide 134 in any suitable fashion. For example, strand 190 and strand 196 can be received by guide surface 174 of strand guide 134 and can be substantially aligned with respective portions of strand guide 134.

Figure 11:
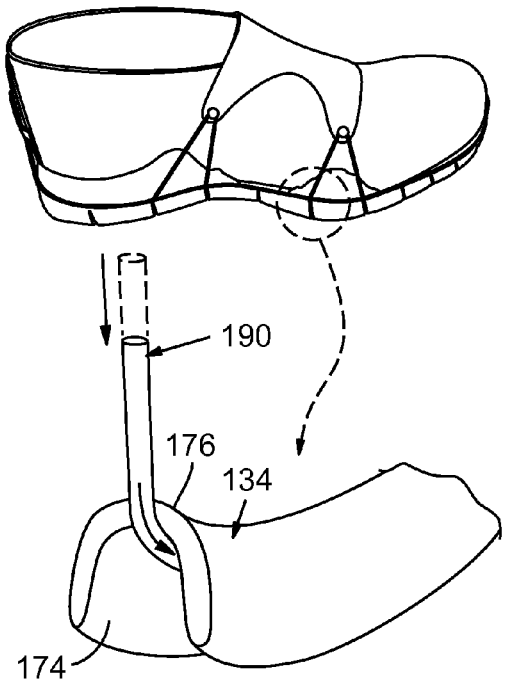
FIGS. 11 and 12 are perspective views of portions of the tensioning system and strand guide of the compressive fitting system of FIG. 1.
Figure 12:
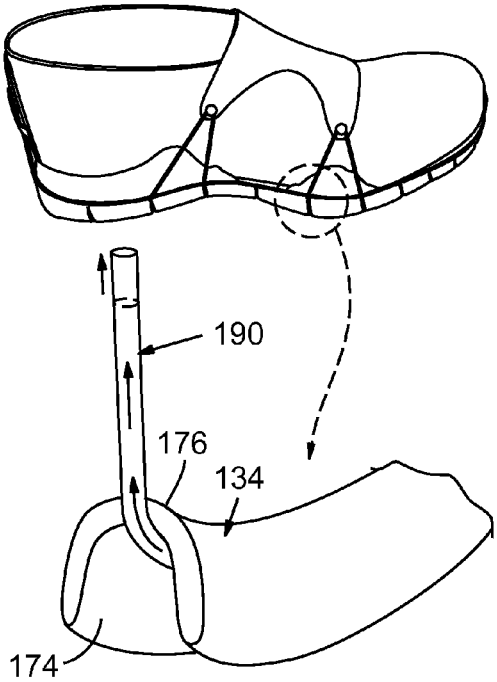

Also, as shown in FIGS. 11 and 12, strand 190 can abut and slide across guide surface 174 of strand guide 134. By comparing FIGS. 11 and 12, it will be apparent that strand 190 can slide in both longitudinal directions across guide surface 174. It will be appreciated that second strand 196 can similarly slide across respective portions of guide surface 174. It will also be apparent that the recessed, U-shaped contour of guide surface 174 can direct and guide strand 190 and strand 196 toward the inner apex of guide surface 174. Accordingly, the guide surface 174 can help retain strand 190 and strand 196 against the guide surface 174 of strand guide 136.

Figure 13:
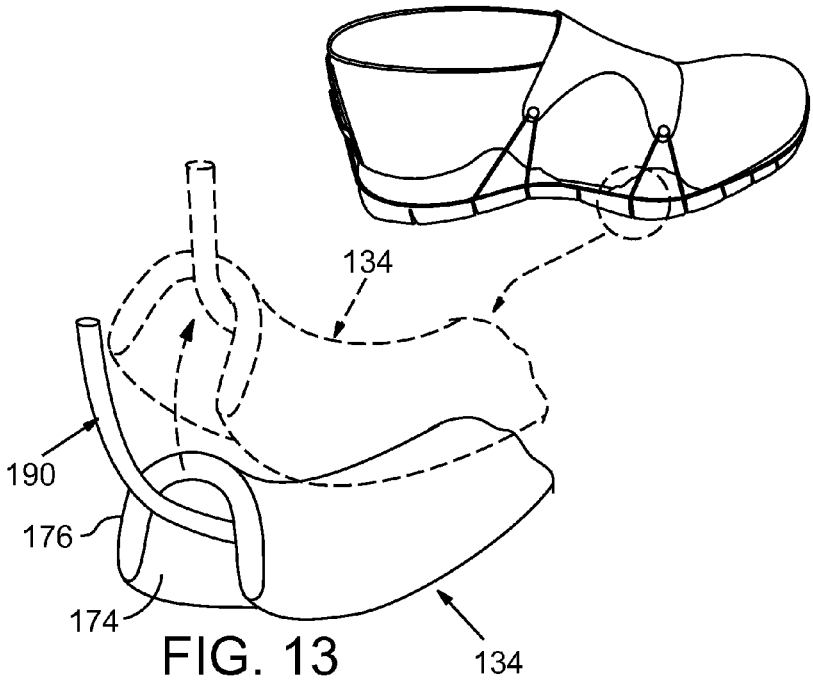
FIG. 13 is a perspective view of the tensioning system and strand guide shown in flexion.

Furthermore, as shown in FIG. 13, strand guide 134 can flex as a result of changing tension in strand 190. For example, strand guide 134 can bend resiliently between a neutral position shown in solid lines in FIG. 13 and a flexed position shown in phantom in FIG. 13. It will be appreciated that second strand 196 can similarly cause flexion of respective portions of strand guide 134.

As represented in the exemplary embodiment of FIG. 23, the upper member 132 and the strand guide 134 are shown in a neutral position in solid lines. The upper member 132 and strand guide 134 are also shown in a flexed position in phantom in FIG. 23. The tensioning system 136 is shown with broken lines for purposes of clarity; however, it will be apparent from the above description that tensioning system 136 can bias upper member 132 generally toward strand guide 134. As described above with respect to FIGS. 10 and 13, changing tension in the tensioning system 136 can cause movement of the upper member 132 and the strand guide 134 between the neutral and flexed position. Assuming that the upper member 132 and strand guide 134 are in the neutral position, an increase in tension in tensioning system 136 can pull upper member 132 toward the strand guide 134 and, thus, the sole structure 110. At the same time, ends 176 of strand guide 134 can rotate inward and upward toward upper member 132. Accordingly, upper member 132 and strand guide 134 can compress toward each other in multiple directions and, as a result, the fitting system 130 can cause the footwear 100 to fit tighter to the wearer's foot. It will be appreciated that reducing tension in tensioning system 136 can allow upper member 132 and strand guide 134 to move away from each other for looser fitting footwear 100.

As mentioned above, strand 190 and strand 196 can slide longitudinally and adjust with respect to upper member 132 and strand guide 134. Thus, tensioning system 136 can adjust to changes in tension while the wearer's foot flexes and moves within footwear 100. Stated differently, the wearer's foot may flex so as to increase in volume and push outward on some portions of the inner surface of upper 120. These forces can, for example, push outward on upper member 132 to increase tension in tensioning system 136. The tensioning system 136 can slide relative to upper member 132 to accommodate such changes in tension. Likewise, running, jumping, and other activities can involve flexure of the sole structure 110; however, strand guide 134 can flex in concert with sole structure 110, and tensioning system 136 can slide along strand guide 134 to accommodate such flexure. As such, the fit of footwear 100 can automatically adjust to keep the wearer's foot comfortable and properly supported during such movement.

More specifically, as shown in FIGS. 3, 4, 7, 17, and 18, strand 190 can define a section height 268. For example, as shown in FIG. 3, section 254 has a section height 268 defined from the respective vertex 205, where the strand 190 is coupled to the upper member 132, to the adjacent horizontal section 252, where the strand 190 is coupled to the strand guide 134. Stated differently, the section 254 can freely extend between upper member 132 and strand guide 134 along the section height 268. Section 264 defines a similar section height 268 as shown in FIG. 4. Similarly, section 256 and section 262 can also each define a respective section height 268. Moreover, strand 196 can define similar section heights 268 for section 274, section 276, section 282, and section 284.

It will be appreciated that section height 268 of the sections can adjust due to changing tension of strand 190 and strand 196. Section heights 268 can also change as the upper member 132 moves toward and away from strand guide 134.

Figure 17:
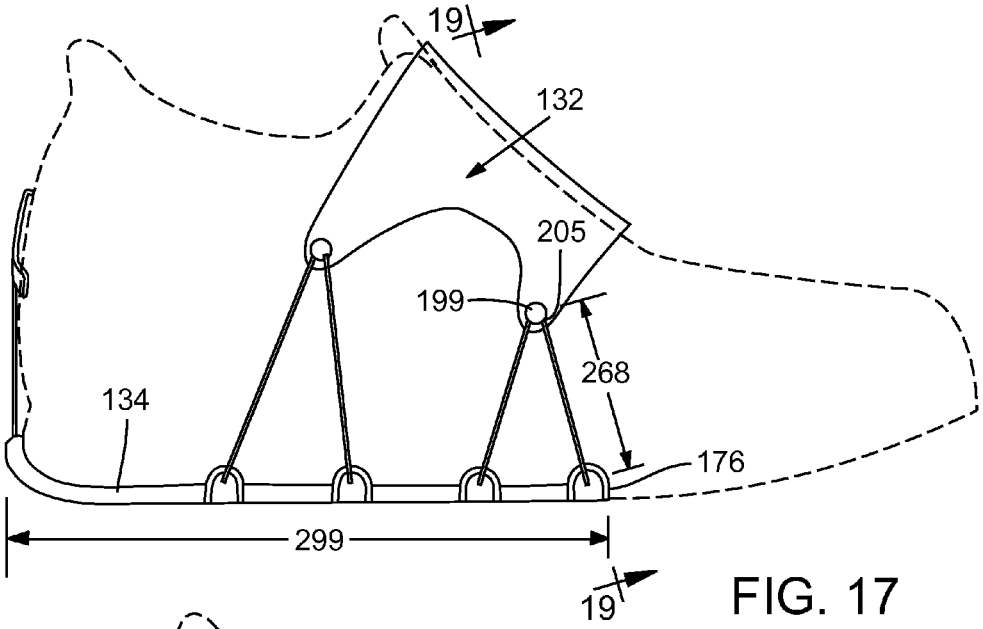
FIG. 17 is a side view of the compressive fitting system shown in a neutral position with the upper and the sole structure shown in phantom.
Figure 18:
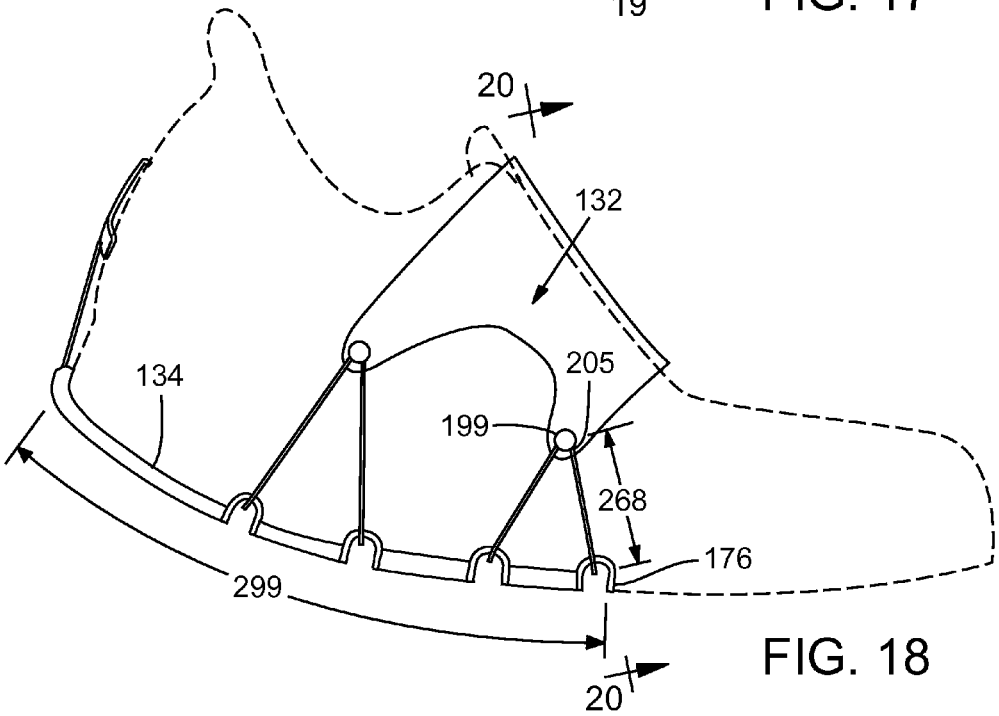
FIG. 18 is a side view of the compressive fitting system shown in a flexed position with the upper and the sole structure shown in phantom.

Section heights 268 can further change as the strand guide 134 flexes. For example, as shown in FIGS. 17 and 18, footwear 100 can flex and bend in the fore/aft direction to flex strand guide 134. As a result, tensioning system 136 can pull upper member 132 toward strand guide 134. Stated differently, longitudinal member 152 of strand guide 134 can have a longitudinal length 299 as shown in FIG. 17, and longitudinal member 152 can be substantially straight along the length 299. Flexure of the strand guide 134 can increase the curvature of the longitudinal member 152 along the length 299 as shown in FIG. 18. Strand guide 134 can, thus, pull on the strand 190 and/or the strand 196 due to this flexure. Strand 190 and/or strand 196 can accommodate this change in curvature by sliding over fasteners 199 and ends 176. As such, section height 268 can be smaller in the flexed position of FIG. 18 as compared to the neutral position of FIG. 17. Also, upper member 132 can be pulled toward strand guide 134 and toward the wearer's foot.

Figure 19:
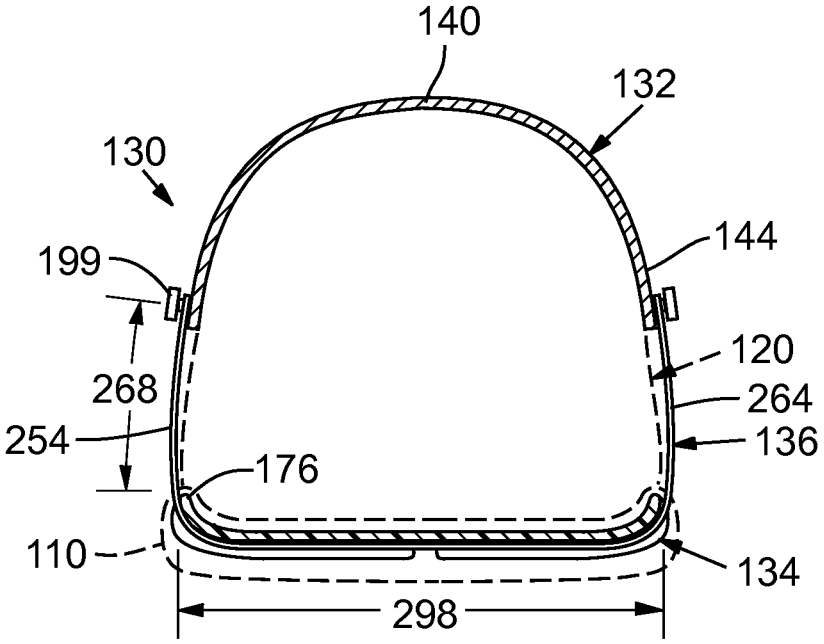
FIG. 19 is a section view of the article of footwear with the upper and the sole structure shown in phantom and the compressive fitting system shown in a neutral position.
Figure 20:
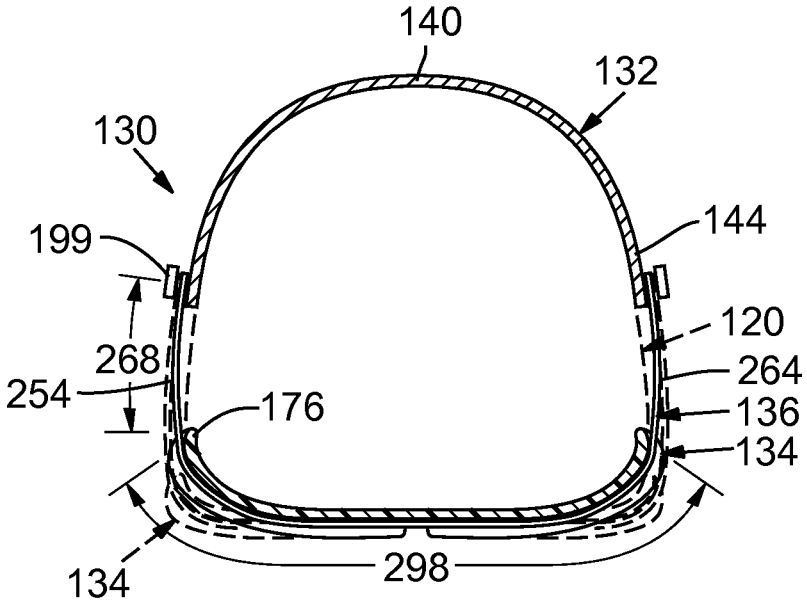
FIG. 20 is a section view of the article of footwear with the upper and the sole structure shown in phantom and the compressive fitting system shown in a flexed position.

Similarly, footwear 100 can flex in the medial/aft direction as shown in FIGS. 19 and 20. As a result, tensioning system 136 can pull upper member 132 toward strand guide 134. Stated differently, strand guide 134 can define a transverse length 298 defined between opposing ends 176, and strand guide 134 can be substantially straight along the length 298 as shown in FIG. 19. Flexure of the strand guide 134 can increase the curvature of the strand guide 134 along the length 298 as shown in FIG. 20. Stand guide 134 can, thus, pull on the strand 190 and/or the strand 196 due to this flexure. Strand 190 and/or strand 196 can accommodate this change in curvature by sliding over fasteners 199 and ends 176. As such, section height 268 can be smaller in the flexed position of FIG. 20 as compared to the neutral position of FIG. 19. Also, upper member 132 can be pulled toward strand 134 and toward the wearer's foot.

As mentioned above, tensioning system 136 can be attached to heel region 103 of upper 120. Specifically, first end 192 and second end 194 of first strand 190 can be attached to heel region 103. First end 198 and second end 200 of second strand 196 can be attached to heel region 103 of upper 120. It will be appreciated, however, that any portion of strand 190 and/or strand 196 can be attached to heel region 103 using any suitable means.

Tensioning system 136 can, thus, be attached to heel region 103 and to upper member 132 at the medial side 105 and lateral side 104 while also extending longitudinally and transversely across sole structure 110. This routing of tensioning system 136 can allow for a high degree of adjustability of footwear 100 relative to the wearer's foot.

Moreover, as mentioned above and as shown in FIGS. 1-4, fitting system 130 can include an adjustment device 135 that allows for selective adjustment of tension within strand 190 and/or strand 196. For example, in the illustrated embodiments, adjustment device 135 can include a fastening portion 137 of tensioning system 136 and a retainer 138 that is included on at least one of upper 120 and sole structure 110. More specifically, first and/or second strand 190, 196 can define the fastening portion 137 of tensioning system 136, and fastening portion 137 can selectively attach or fasten to retainer 138 in one or more fastened configurations represented in FIGS. 14 and 15. Fastening portion 137 can also be configured to detach or unfasten from retainer 138 in an unfastened configuration represented in FIG. 16.

It will be appreciated that by moving fastening portion 137 between the fastened and unfastened configurations, tension of tensioning system 136 can be adjusted. As a result, the biasing or compression bad level of upper member 132 toward strand guide 134 can be adjusted.

In some embodiments, ends 192, 194, 198, 200 of strands 190, 196 can be attached to a hook 201 to define the fastening portion 137 of tensioning system 136. Also, as shown in FIGS. 1, 2, and 3, retainer 138 can include a body 202 that is supported by upper 120. Body 202 can also be at supported by sole structure 110 in some embodiments. Body 202 can be substantially rigid and can be incorporated in a heel counter of upper 120 in some embodiments. Body 202 can be made from rigid, relative lightweight material, such has hard plastic. Body 202 can also have ribs, honeycomb, or other projections that increase rigidity, strength, or other structural support.

Body 202 can further include one or more retaining features 204 as shown in FIGS. 3 and 4. For example, body 202 can include two or more openings 206 that are arranged in a vertically-extending row. Hook 201 can be received and retained in any of the openings 206.

Figure 14:
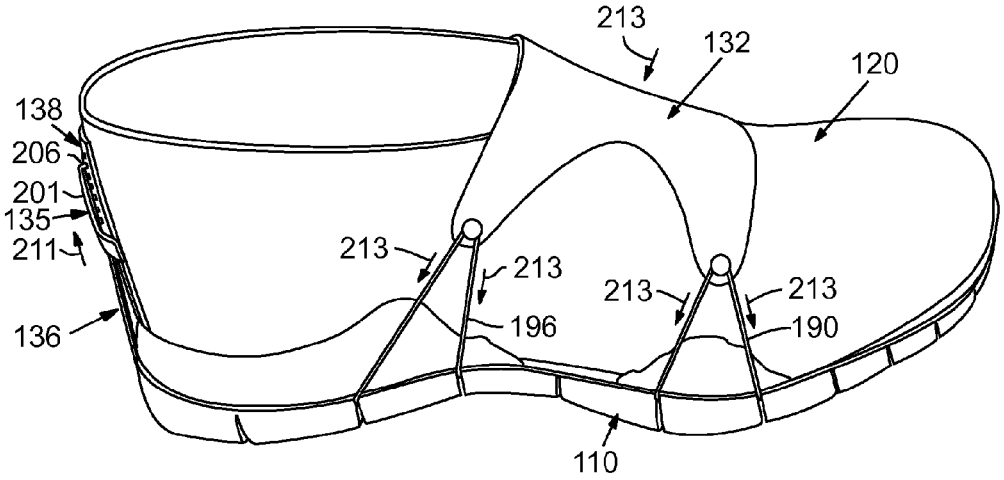
FIG. 14 is a lateral view of the article of footwear of FIG. 1 with the compressive fitting system shown at a first fastened configuration.

In a first fastened configuration shown in FIG. 14, hook 201 is received in an opening 206 of retainer 138. In a second fastened configuration shown in FIG. 15, hook 201 is received in an opening 206 located further downward on body 202. In an unfastened configuration shown in FIG. 16, hook 201 is unfastened from retainer 138.

Figure 16:
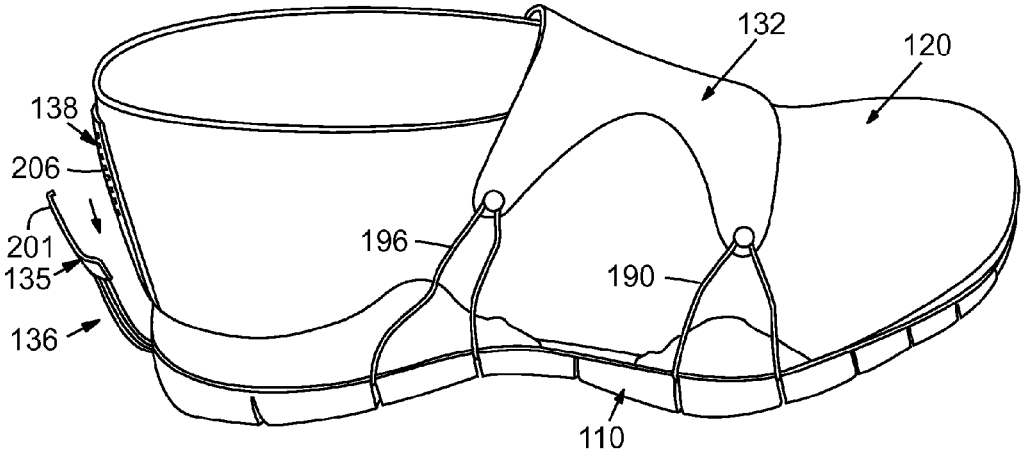
FIG. 16 is a lateral view of the article of footwear of FIG. 1 with the compressive fitting system shown at an unfastened configuration.

To move tensioning system 136 from unfastened configuration of FIG. 16 to first fastened configuration of FIG. 14, wearer can pull hook 201 upward in the direction of arrow 211. This can consequently pull and increase tension in first and second strands 190, 196 to bias and compress upper member 132 toward strand guide 134 in the direction of arrows 213. Also, midfoot region 102, lateral side 104, and/or medial side 105 of upper 120 can more closely conform to the wearer's foot due to such tightening of fitting system 130. Likewise, such loading of strand guide 134 can transfer to sole structure 110 to flex sole structure 110 and conform sole structure 110 to the sole of the wearer's foot.

Figure 15:
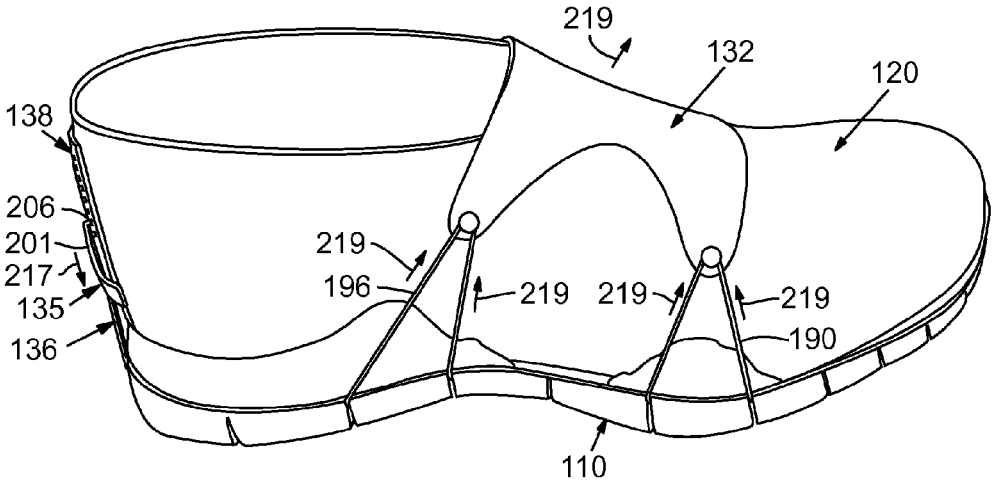
FIG. 15 is a lateral view of the article of footwear of FIG. 1 with the compressive fitting system shown at a second fastened configuration.

If the wearer so chooses, fitting system 130 can be loosened somewhat by moving the tensioning system 136 from the first fastened configuration of FIG. 14 to the second fastened configuration of FIG. 15. Specifically, hook 201 can be moved downward in the direction of arrow 217 in FIG. 15. As a consequence, tension can be reduced in tensioning system 136. Also, upper member 132 can move slightly away from sole structure 110 and strand guide 134 in the direction of arrows 219.

Moreover, to further loosen fitting system 130, the wearer can unfasten the hook 201 from retainer 138 as shown in FIG. 16. The wearer may wish to move fitting system 130 to the unfastened configuration to insert foot into void 122 or to remove foot from void 122 of upper 120.

Figure 21:
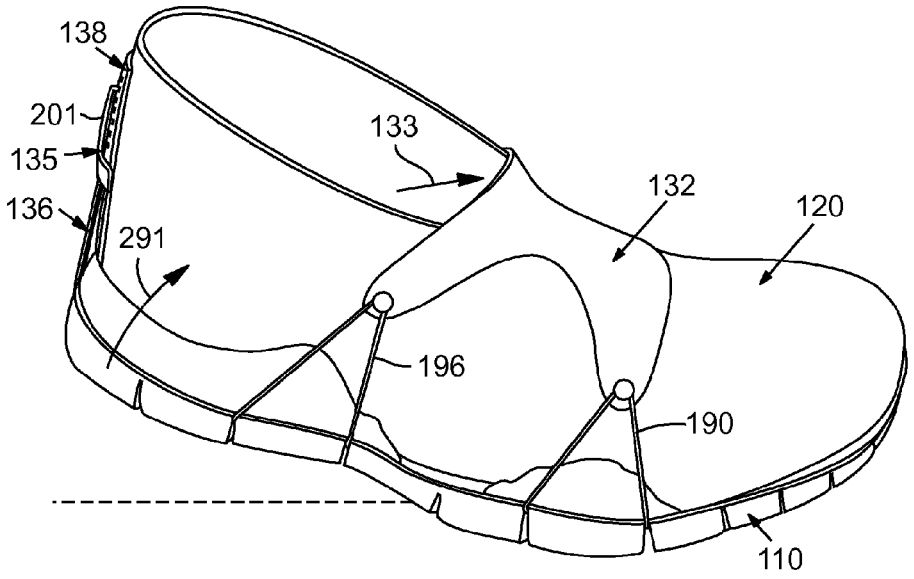
FIG. 21 is a lateral view of the article of footwear of FIG. 1 shown in plantarflexion.
Figure 22:
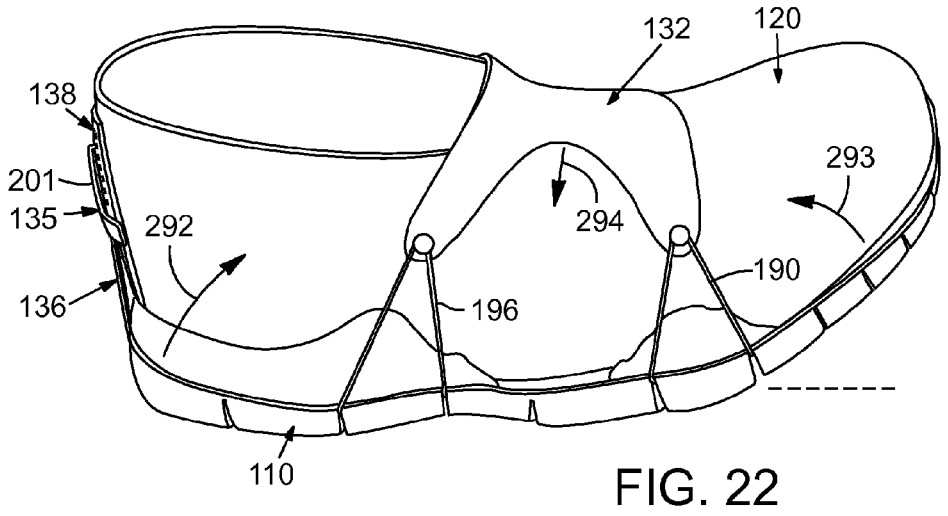
FIG. 22 is a lateral view of the article of footwear of FIG. 1 shown in dorsiflexion.

Moreover, FIGS. 21 and 22 illustrate how fitting system 130 can automatically adjust the fit of footwear 100 on the wearer's foot during flexion, extension or other movement of the wearer's foot and/or due to impact with the ground surface. FIG. 21 can represent the position of the wearer's foot and footwear 100 when thrusting forward from the ground surface when running or jumping. FIG. 22 can represent the wearer's foot and footwear 100 when the footwear 100 lands back on the ground surface.

For example, during plantarflexion of the wearer's foot represented in FIG. 21, the wearer's ankle and midfoot can press upward to supply an input force to upper member 132 as represented by arrow 133. As a result, tension in strands 190, 196 can increase to draw strand guide 134 upward generally toward the sole of the wearer's foot. Specifically, as shown in FIG. 21, a reaction load represented by arrow 291 can be transferred to strand guide 134 adjacent heel region 103. In some embodiments, reaction load 291 can be a bending moment that causes end 170 of strand guide 134 to bend upward toward the sole and heel of the wearer's foot. Thus, the fitting system 130 can cause the sole structure 110 at heel region 103 to pull toward the wearer's foot.

In contrast, FIG. 22 illustrates footwear 100 during dorsiflexion of the wearer's foot. As shown, flexure of sole structure 110 can cause flexure of strand guide 134 as represented by curved arrows 292, 293 in FIG. 22. This flexure can increase tension in tensioning system 136 such that upper member 132 is pulled downward against the wearer's foot as represented by arrow 294 in FIG. 22.

Accordingly, the fitting system 130 allows footwear 100 to comfortably fit and conform to the wearer's foot. Also, movements of the wearer's foot during running, jumping, flexure, and extension can cause the fitting system 130 to adjust. Stated differently, fitting system 130 can tighten one or more areas of footwear 100 to the wearer's foot as the foot moves.

Figure 24:
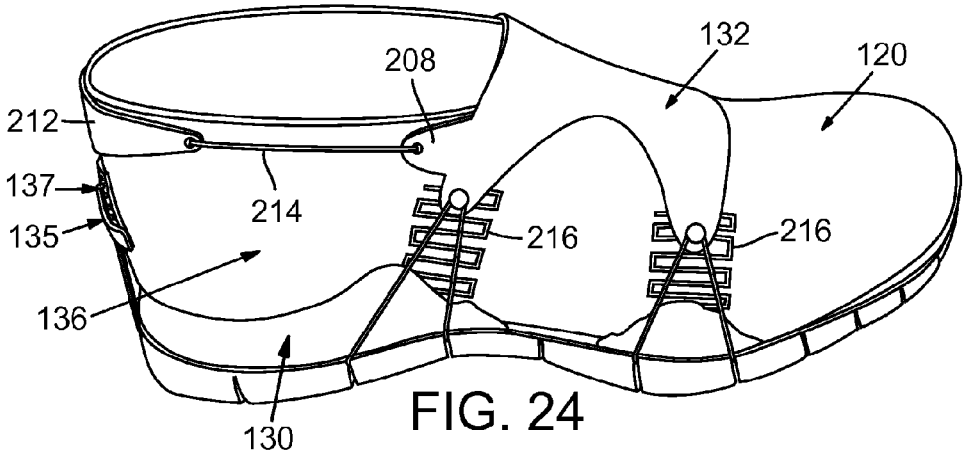
FIG. 24 is a lateral view of the article of footwear according to additional embodiments of the present disclosure.
Figure 25:
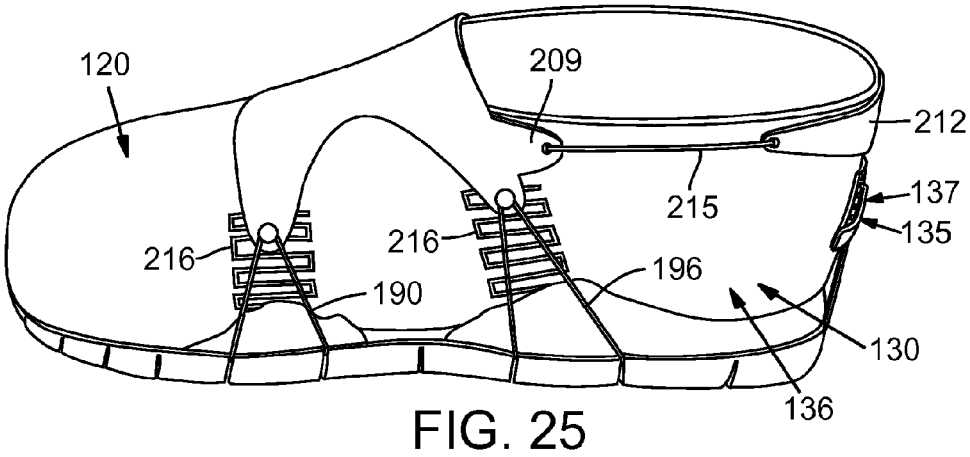
FIG. 25 is a medial view of the article of footwear of FIG. 24.

Turning now to FIGS. 24 and 25, additional embodiments are illustrated. As shown, footwear can be substantially similar to the embodiments of FIGS. 1-23. However, upper member 132 can additionally include a lateral heel projection 208 as shown in FIG. 24 and a medial heel projection 209 as shown in FIG. 25. Heel projections 208, 209 can extend generally toward heel region 103 of footwear.

Also, fitting system 130 can include a heel strap 212 that is supported by heel region of footwear. Moreover, tensioning system 136 can include a lateral heel strand 214 as shown in FIG. 24 and a medial heel strand 215 as shown in FIG. 25. Lateral heel strand 214 can couple and extend between lateral heel projection 208 and one end of heel strap 212, and medial heel strand 215 can couple and extend between medial heel projection 208 and the opposite end of heel strap 212.

Thus, fitting system 130 can additionally pull heel region 103 into the wearer's heel due to movement of the wearer's foot and flexure of other areas of footwear. For example, plantarflexion of the foot can load the upper member 132 such that heel strands 214, 215 pull heel strap 212 against wearer's heel. This can further allow footwear to fit comfortably and adjustably against wearer's foot.

Moreover, as shown in FIGS. 24 and 25, footwear can include projections 216 that project outwardly from upper 120. Projections 216 can be of any suitable type. For example, projections 216 can be raised strips of material, such as polymeric material. The projections 216 can extend in an aesthetically pleasing pattern. For example, projections 216 can extend in a serpentine pattern on upper 120. Projections 216 can be disposed underneath respective ones of the inverted "V" of the tensioning system 136. The tensioning system 136 can abut against projections 216 and can be supported against projections 216. For instance, the tensioning system 136 can slide over projections 216, and projections 216 can protect surrounding portions of upper 120 from abrasion or other damage. The projections 216 can also be configured to guide tensioning system 136. For example, the projections 216 can include a groove or other opening that receives tensioning system 136 and keeps tensioning system 136 in a predetermined position relative to the upper 120.

Figure 26:
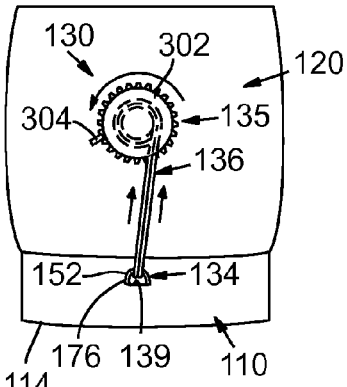
Figure 27:
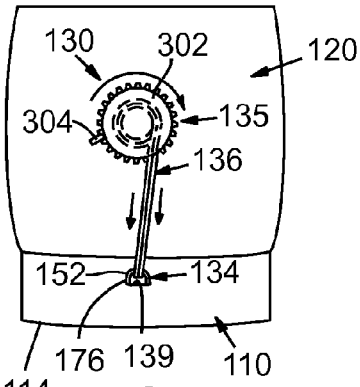

Referring now to FIGS. 26 and 27, still further embodiments are illustrated. Footwear can be substantially similar to the embodiments discussed above. However, the adjustment device 135 can be different. For example, adjustment device 135 can include a spool 302 on which strands of tensioning system 136 can spool and unspool. Specifically, by rotating spool 302 in one direction, tensioning system 136 can advance toward spool 302, and a portion of tensioning system 136 can gather onto spool 302 to increase tension in tensioning system 136. By rotating spool 302 in the opposite direction, the portion of tensioning system 136 can unspool from spool 302 to decrease tension in tensioning system 136.

Adjustment device 135 can further include a catch 304 that can retain spool 302 at a selected angular position. In some embodiments, for example, catch 304 can be a pawl that engages spokes extending from spool 302. It will be appreciated that adjustment device 135 can include a release mechanism with which the user can release the catch 304 for unspooling tensioning system 136. Also, in some embodiments, adjustment device 135 can incorporate one or more features disclosed in U.S. Pat. No. 5,934,599, issued on Aug. 10, 1999 to Hammerslag, U.S. Pat. No. 6,202,953, issued on Mar. 20, 2001 to Hammerslag, and/or U.S. Pat. No. 6,289,558, issued Sep. 18, 2001 to Hammerslag, each of which is hereby incorporated by reference in its entirety.

Moreover, as shown in FIGS. 26 and 27, strand guide 134 can be substantially enclosed within sole structure 110. Stated differently, ground engaging surface 114 can cover over strand guide 134. For example, sole structure 110 can include a cavity having a size and dimension conforming to that of strand guide 114, and strand guide 114 can be encapsulated within the cavity. Also, sole openings 139, such as through-holes, can expose ends 176 of strand guide 114 and/or allow passage of strands of tensioning system 136.

In still further embodiments, ends 176 can extend upward from sole structure 110 to be disposed on upper 120. For example, ends 176 can overlap and abut respective portions of upper 120.

Figure 28:
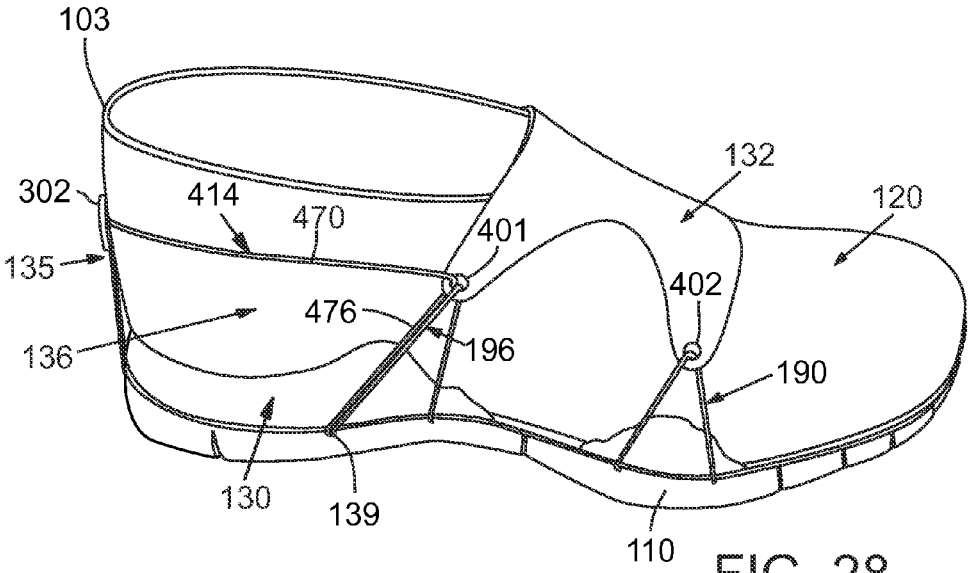
FIG. 28 is a lateral view of the article of footwear according to additional embodiments of the present disclosure.

Referring now to FIG. 28, additional embodiments of the article of footwear 100 are illustrated. As shown in FIG. 28, footwear 100 can be substantially similar to embodiments discussed above, except as noted herein.

For example, fitting system 130 can include an upper member 132 that is coupled to strands of tensioning system 136 in a different manner. More specifically, as shown in the illustrated embodiments, the upper member 132 can include one or more openings that receive the strands. As shown in FIG. 28, the upper member 132 can include a rear opening 401 and a forward opening 402. The rear opening 401 and forward opening 402 can receive at least one strand of the tensioning system 136 to thereby couple to the respective strand(s).

Also, as shown in FIG. 28, the adjustment device 135 can include a spool 302, similar to the embodiments of FIGS. 26 and 27. Also, portions of the strands of the tensioning system 136 can be enclosed within sole structure 110. The strands can extend out of the sole openings 139, similar to the embodiments discussed above in relation to FIGS. 26 and 27. It will be appreciated that the strand guide 134 can be similarly enclosed and embedded in sole structure 110, similar to the embodiments of FIGS. 26 and 27.

Figure 29:
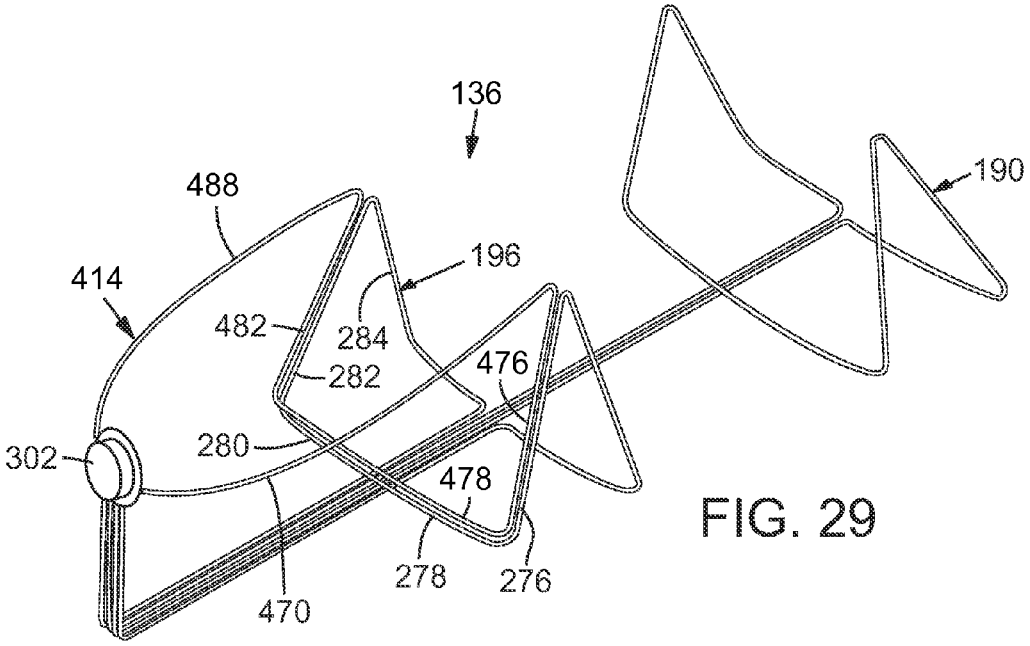
FIG. 29 is a perspective view of a tensioning system of the compressive fitting system of the article of footwear of FIG. 28.

Additionally, as shown in FIGS. 28 and 29, tensioning system 136 can include first strand 190, second strand 196, as well as a heel strand 414. The first strand 190 and second strand 196 can be substantially similar to the embodiments discussed above. However, the heel strand 414 can extend between and can be coupled to the heel region 103 of the upper 120, the upper member 132 of the fitting system 130, and the sole structure 110.

More specifically, as shown in FIG. 29, the heel strand 414 can include a first horizontal section 470 that is coupled to the spool 302. The first horizontal section 470 can be spooled and unspooled from the spool 302. Also, the first horizontal section 470 can extend from the spool 302 across the lateral side 104 of the heel region 103 and can be received within the rear opening 401 to couple to the upper member 132. The heel strand 414 can also include a first vertical section 476 that extends from the rear opening 401 toward the sole structure 110. The first vertical section 476 can extend substantially parallel to the section 276 of the second strand 196. Also, the heel strand 414 can include a second horizontal section 479 that can be coupled to the strand guide 134 and that can extend substantially parallel to the section 278 and the section 280 of the second strand 196. Moreover, the heel strand 414 can include a second vertical section 482 that extends out of the sole structure 110 and that extends upward toward upper member 132 to couple to upper member 132 on the medial side 105 of the footwear 100. The second vertical section 482 can be substantially parallel to the section 282 of the strand 196. Furthermore, the heel strand 414 can include a third horizontal section 488 that extends back toward spool 302. The third horizontal section 488 can be spooled and unspooled from spool 302.

The heel strand 414 can function similar to the heel strap 212, strand 214, and strand 215 of the embodiments of FIGS. 24 and 25 to pull heel region 103 toward the wearer's heel. Tension in heel strand 414 can also be selectively adjusted by the wearer to change the amount of force applied by the heel region 103 onto the wearer's foot by rotating the spool 302 in either direction. Moreover, tension in the heel strand 414 can adjust in concert with the strand 190 and the strand 196 to adjust the fit of the footwear 100 according to the movements of the wearer's foot. Also, since heel strand 414 extends into sole structure 110, heel strand 414 can pull upper member 132, heel region 103, and sole structure 110 generally toward each other to compress the wearer's foot.

In summary, embodiments of fitting system 130 described above and shown in FIGS. 1-29 can allow footwear 100 to comfortably and securely fit to wearer's foot. The fit of footwear 100 can be quickly and easily adjusted by the wearer. Also, fit of the footwear 100 can automatically adjust during ambulatory movements of the wearer's foot. Accordingly, the footwear 100 can increase the wearer's ability to run, jump, or otherwise move.

While various embodiments of the present disclosure have been described, the description is intended to be exemplary, rather than limiting and it will be apparent to those of ordinary skill in the art that many more embodiments and implementations are possible that are within the scope of the present disclosure. Accordingly, the present disclosure is not to be restricted except in light of the attached claims and their equivalents. Also, various modifications and changes may be made within the scope of the attached claims.

What is claimed is:

1. An article of footwear comprising:

an upper;

a sole structure coupled to the upper and including a ground-engaging surface and a groove formed in the ground-engaging surface;

an upper member disposed adjacent to the upper and including a first fastener disposed on one of a lateral side of the upper and a medial side of the upper; and a tensioning system including a flexible strand operable to selectively bias the upper member toward the sole structure, the flexible strand being received within the groove formed in the ground-engaging surface of the sole structure and including a first section that extends from the first fastener to the sole structure in a first direction and a second section that extends from the first fastener to the sole structure in a second direction divergent from the first direction, the first section and the second section being disposed on the same side of the upper as the first fastener.

2. The article of footwear of claim 1, wherein the groove includes a groove longitudinal portion and at least two groove transverse portions extending from the groove longitudinal portion, the groove longitudinal portion and the at least two groove transverse portions each receiving the flexible strand therein.

3. The article of footwear of claim 2, further comprising a strand guide disposed within the groove of the sole structure and including a guide longitudinal portion and at least two guide transverse portions, the guide longitudinal portion aligned with the groove longitudinal portion and the at least two guide transverse portions aligned with respective ones of the groove transverse portions.

4. The article of footwear of claim 3, wherein the strand guide is flexible and is configured to flex in concert with the sole structure, the strand guide receiving the flexible strand therein.

5. The article of footwear of claim 1, wherein the flexible strand includes a third section that extends from the sole structure to a second fastener associated with the upper member and returns back to the sole structure and a fourth section that extends from the sole structure to a third fastener associated with the upper member and returns back to the sole structure, the second fastener and the third fastener each being disposed on the other of the lateral side of the upper and the medial side of the upper.

6. The article of footwear of claim 1, wherein the groove includes multiple grooves formed in the ground engaging surface of the sole structure.

7. The article of footwear of claim 6, wherein the flexible strand is received within the multiple grooves.

8. The article of footwear of claim 1, wherein the groove includes a first groove and a second groove, the flexible strand extending across the sole structure between a medial side of the sole structure and a lateral side of the sole structure within one of the first groove and the second groove.

9. The article of footwear of claim 8, wherein the other of the first groove and the second groove extends from the one of the first groove and the second groove toward a heel portion of the sole structure, the flexible strand extending within the other of the first groove and the second groove toward the heel portion.

10. The article of footwear of claim 9, further comprising a tensioning device disposed proximate to the heel portion and receiving the flexible strand, the tensioning device operable to selectively draw the upper member toward the sole structure by tensioning the flexible strand at the heel portion.

11. An article of footwear comprising:

an upper;

a sole structure coupled to the upper and including a ground-engaging surface and a groove formed in the ground-engaging surface;

an upper member disposed adjacent to and covering a portion of the upper; and a tensioning system including a flexible strand operable to selectively bias the upper member toward the sole structure and extending between the upper member and the sole structure, the flexible strand including a first portion that extends from the sole structure to a first fastener associated with the upper member and returns back to the sole structure and a second portion that extends from the sole structure to a second fastener associated with the upper member and returns back to the sole structure, the first portion and the second portion being disposed on the same side of the upper.

12. The article of footwear of claim 11, wherein the flexible strand is received within the groove formed in the ground-engaging surface of the sole structure.

13. The article of footwear of claim 11, wherein the groove includes a groove longitudinal portion and at least two groove transverse portions extending from the groove longitudinal portion, the groove longitudinal portion and the at least two groove transverse portions each receiving the flexible strand therein.

14. The article of footwear of claim 13, further comprising a strand guide disposed within the groove of the sole structure and including a guide longitudinal portion and at least two guide transverse portions, the guide longitudinal portion aligned with the groove longitudinal portion and the at least two guide transverse portions aligned with respective ones of the groove transverse portions.

15. The article of footwear of claim 14, wherein the strand guide is flexible and is configured to flex in concert with the sole structure, the strand guide receiving the flexible strand therein.

16. The article of footwear of claim 11, wherein the groove includes multiple grooves formed in the ground engaging surface of the sole structure.

17. The article of footwear of claim 16, wherein the flexible strand is received within the multiple grooves.

18. The article of footwear of claim 11, wherein the groove includes a first groove and a second groove, the flexible strand extending across the sole structure between a medial side of the sole structure and a lateral side of the sole structure within one of the first groove and the second groove.

19. The article of footwear of claim 18, wherein the other of the first groove and the second groove extends from the one of the first groove and the second groove toward a heel portion of the sole structure, the flexible strand extending within the other of the first groove and the second groove toward the heel portion.

20. The article of footwear of claim 19, further comprising a tensioning device disposed proximate to the heel portion and receiving the flexible strand, the tensioning device operable to selectively draw the upper member toward the sole structure by tensioning the flexible strand at the heel portion.

* * * * *